US010519915B2

(12) United States Patent
Noguchi

(10) Patent No.: US 10,519,915 B2
(45) Date of Patent: Dec. 31, 2019

(54) FUEL INJECTION DEVICE NOZZLE PLATE

(71) Applicant: ENPLAS CORPORATION, Saitama (JP)

(72) Inventor: Koji Noguchi, Saitama (JP)

(73) Assignee: Enplas Corporation, Saitama (JP)

( * ) Notice: Subject to any disclaimer, the term of this patent is extended or adjusted under 35 U.S.C. 154(b) by 13 days.

(21) Appl. No.: 15/117,554

(22) PCT Filed: Jan. 15, 2015

(86) PCT No.: PCT/JP2015/050888
§ 371 (c)(1),
(2) Date: Aug. 9, 2016

(87) PCT Pub. No.: WO2015/122231
PCT Pub. Date: Aug. 20, 2015

(65) Prior Publication Data

US 2016/0356253 A1 Dec. 8, 2016

(30) Foreign Application Priority Data

Feb. 12, 2014 (JP) ..... 2014-024897
Jun. 4, 2014 (JP) ..... 2014-115441

(51) Int. Cl.
*F02M 61/16* (2006.01)
*F02M 61/18* (2006.01)

(52) U.S. Cl.
CPC ..... *F02M 61/162* (2013.01); *F02M 61/184* (2013.01); *F02M 61/1833* (2013.01);
(Continued)

(58) Field of Classification Search
CPC ..... F02M 61/162; F02M 61/1833; F02M 61/184; F02M 61/1853; F02M 2200/8046; F02M 2200/1853
(Continued)

(56) References Cited

U.S. PATENT DOCUMENTS 2,985,234 A * 5/1961 Golden ..... F23D 14/04 239/490
3,116,017 A * 12/1963 Kucmerosky ..... F02K 3/00 239/404
(Continued)

FOREIGN PATENT DOCUMENTS

JP 5-133300 5/1993
JP 10-122097 5/1998
(Continued)

OTHER PUBLICATIONS

International Search Report dated Apr. 14, 2015 in International (PCT) Application No. PCT/JP2015/050888.

*Primary Examiner* — Steven J Ganey
*Assistant Examiner* — Joseph A Greenlund
(74) *Attorney, Agent, or Firm* — Wenderoth, Lind & Ponack, L.L.P.

(57) ABSTRACT

A nozzle plate has a plurality of blades in the area that surrounds the nozzle hole on the outer plane of the bottom wall part. When the fuel is injected from the nozzle hole and the pressure in the vicinity of the nozzle hole is reduced, the plurality of blades guide a flow of air from the radially outward side of the bottom wall part to the radially inward side of the bottom wall part and generates a swirling flow of the air about the center of the bottom wall part. The swirling flow of the air about the center of the bottom wall part changes to a helical flow by receiving kinetic momentum from fine particles of the fuel injected from the nozzle hole and the helical flow of the air transports the fine particles of the fuel.

16 Claims, 24 Drawing Sheets

(52) U.S. Cl.
CPC . *F02M 61/1853* (2013.01); *F02M 2200/8046* (2013.01); *F02M 2200/9015* (2013.01)

(58) Field of Classification Search
USPC ..... 239/406
See application file for complete search history.

(56) References Cited

U.S. PATENT DOCUMENTS 3,790,086 A * 2/1974 Masai ..... B05B 7/0416 239/406
4,644,878 A * 2/1987 Nodd ..... F23D 1/005 110/264
4,785,996 A * 11/1988 Ziecker ..... B05B 7/0861 239/298
5,232,163 A * 8/1993 Grytz ..... F02M 67/00 239/403
6,273,349 B1 8/2001 Fischbach et al.
6,289,677 B1 * 9/2001 Prociw ..... F23C 7/002 60/748
6,311,900 B1 * 11/2001 Slowik ..... F02M 61/162 239/491
6,371,387 B1 * 4/2002 Nally ..... F02M 69/047 239/406
6,539,724 B2 * 4/2003 Cornwell ..... F23D 11/383 60/776
8,033,114 B2 * 10/2011 Hernandez ..... F23R 3/286 239/402
8,348,180 B2 * 1/2013 Mao ..... F23D 11/107 239/403
8,882,003 B2 * 11/2014 Okamoto ..... F02M 61/186 239/468
9,267,475 B2 * 2/2016 Noguchi ..... F02M 61/162
10,047,713 B2 * 8/2018 Noguchi ..... F02M 61/1893
2002/0170987 A1 * 11/2002 Aoki ..... F02M 61/18 239/585.4
2003/0234005 A1 * 12/2003 Sumisha ..... F02M 51/0678 123/467
2004/0011895 A1 * 1/2004 Dantes ..... F02M 51/0671 239/585.1
2004/0061001 A1 * 4/2004 Mao ..... B05B 7/08 239/398
2006/0027217 A1 * 2/2006 Yasukawa ..... F02M 53/06 123/557
2006/0243829 A1 * 11/2006 Oomori ..... F02M 51/061 239/584
2014/0027541 A1 * 1/2014 Okamoto ..... F02M 61/163 239/486
2014/0027542 A1 * 1/2014 Yoshimura ..... F02M 61/163 239/489
2016/0097361 A1 * 4/2016 Noguchi ..... F02M 61/168 239/288.5
2016/0169179 A1 * 6/2016 Noguchi ..... F02M 61/162 239/288.3
2016/0237968 A1 * 8/2016 Noguchi ..... F02M 61/168
2016/0245250 A1 * 8/2016 Noguchi ..... F02M 61/166
2016/0356253 A1 * 12/2016 Noguchi ..... F02M 61/184

FOREIGN PATENT DOCUMENTS

JP 2002-503314 1/2002
JP 2003-322070 11/2003
JP 2006-46229 2/2006
JP 2007-177766 7/2007
JP 2007-211602 8/2007
JP 2009-150270 7/2009
WO 2007/074385 7/2007

* cited by examiner

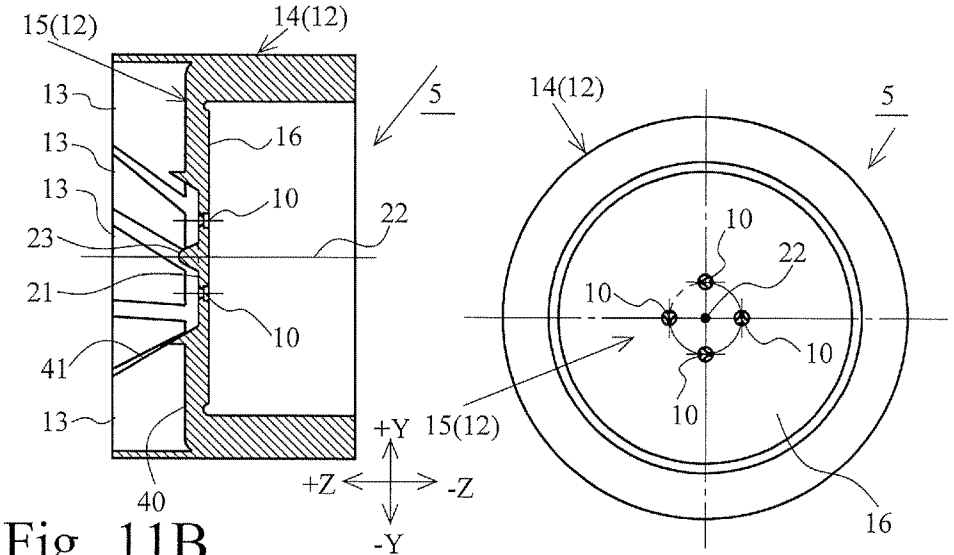
Fig. 11B
Fig. 11D
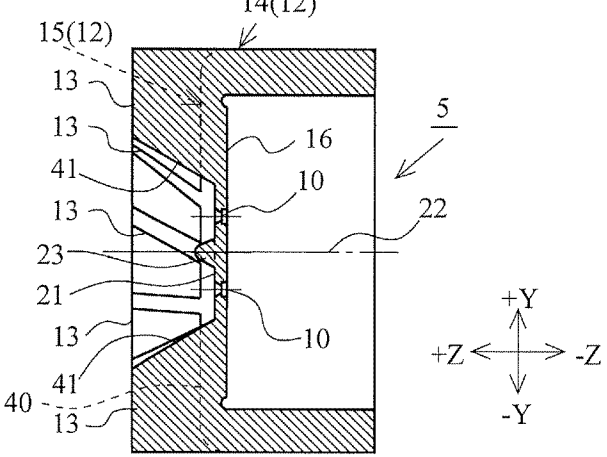
Fig. 11C
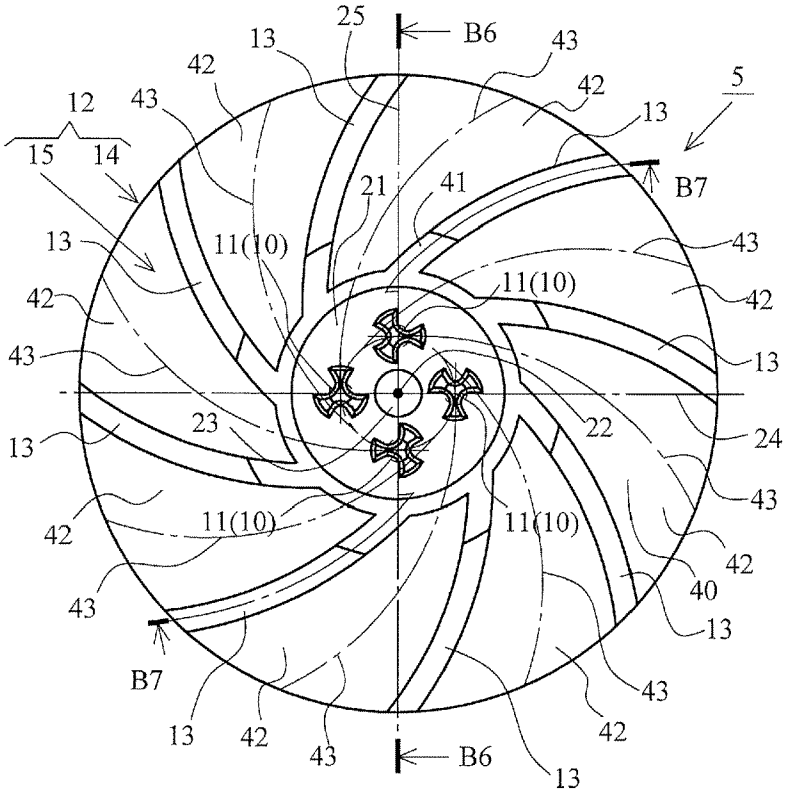
Fig. 11A

FUEL INJECTION DEVICE NOZZLE PLATE

TECHNICAL FIELD

The present invention relates to a fuel injection device nozzle plate, attached to the fuel injection port of a fuel injection device, that atomizes and injects fuel flowing from the fuel injection port.

BACKGROUND ART

An internal combustion engine (abbreviated below as an engine) of an automobile or the like mixes fuel injected from a fuel injection device and air introduced via an intake air pipe to generate a combustible gas mixture and burns the combustible gas mixture in the cylinder. It is known that the mixture state of fuel injected from the fuel injection device and air significantly affects the performance of this type of engine and, in particular, the atomization of fuel injected from the fuel injection device is an important factor governing the performance of the engine.

First Conventional Example

For example, a nozzle plate 1002 illustrated in FIG. 25 is attached to a fuel injection port 1001 of a fuel injection device 1000 and a nozzle hole 1003 is formed as square in plan view so as to be broadened from one side to the other side in the thickness direction. The nozzle plate 1002 is attached to the fuel injection port 1001 of the fuel injection device 1000 so that the one side in the thickness direction is disposed close to the fuel injection port 1001 of the fuel injection device 1000. In addition, in this nozzle plate 1002, an interference body 1005 is formed at a nozzle hole opening edge 1004 on the other end side in the thickness direction so that this interference body 1005 partially blocks the nozzle hole 1003.

In the fuel injection device 1000 having the nozzle plate 1002 described above, when fuel flows from the fuel injection port 1001, then misty fuel F2 flowing along a surface 1008 of an interference body 1005 after colliding with the interference body 1005 collides with fuel F1 flowing along an inner wall surface 1006 of the nozzle hole 1003 and the fuel F1 and the fuel F2 are atomized and injected from the nozzle hole 1003 into an intake air pipe (see JP-A-10-122097).

Second Conventional Example

In addition, in a fuel injection device 1100 illustrated in FIG. 26, a fuel swirling member 1102 for changing a fuel flow to a swirl flow is disposed upstream of a fuel injection port 1101, and a first air orifice 1103, a second air orifice 1104, and an air-fuel mixture branching member 1105 are disposed downstream of the fuel injection port 1101 in this order. In this fuel injection device 1100, the first air orifice 1103 generates a swirl flow of air in a direction opposite to that of a swirl flow of the fuel, and the generated swirl flow of air collides with the fuel injected from the fuel injection port 1101 to atomize the fuel. In addition, in the fuel injection device 1100, the second air orifice 1104 generates a swirl flow (second swirl flow) of air in a direction opposite to that of a swirl flow (first swirl flow) of air generated by the first air orifice 1103, and the second swirl flow collides with fuel having passed through the first air orifice 1103 to perform further fuel atomization. In addition, in the fuel injection device 1100, the first swirl flow and the second swirl flow in the direction opposite to that of the first swirl flow cancel each other in the atomization process of fuel, and the fuel having passed through the first air orifice 1103 and the second air orifice 1104 is branched by the air-fuel mixture branching member 1105 without swirling and then injected (see JP-A-5-133300).

The first and second conventional examples are techniques for atomizing and injecting fuel. However, in the first and second conventional examples, atomized fuel widely scatters and is attached to the wall surface of an intake air pipe and the like so that part of fuel is not directly supplied to the cylinder, thereby causing reduction in the utilization efficiency of fuel.

SUMMARY OF THE INVENTION

An object of the invention is to provide a fuel injection device nozzle plate that prevents fuel flowing from the fuel injection port of a fuel injection device from scattering widely, reduces the amount of fuel attached to the wall surface of an intake air pipe and the like, and improves the utilization efficiency of fuel.

The invention relates to a fuel injection device nozzle plate 5 that is attached to a fuel injection port 6 of a fuel injection device 1, has a nozzle hole 10 through which fuel injected from the fuel injection port 6 passes in a bottom wall part 15 facing the fuel injection port 6, and injects the fuel injected from the fuel injection port 6 into an intake air pipe 2 through the nozzle hole 10, as illustrated in FIGS. 1 to 21. In the invention, when a surface of the bottom wall part 15 facing the fuel injection port 6 is an inner plane 16 and a surface of the bottom wall part 15 opposite to the inner plane 16 is an outer plane 40, the inner plane 16 and the outer plane 40 being front and rear surfaces of the bottom wall part, a plurality of blades 13 are integrally formed in an area of the outer plane 40 of the bottom wall part 15 so as to surround the nozzle hole 10, the area surrounding the nozzle hole 10. When the fuel is injected from the nozzle hole 10 and a pressure in the vicinity of the nozzle hole 10 is reduced, the plurality of blades 13 guide a flow of air from a radially outward side of the bottom wall part 15 to a radially inward side of the bottom wall part 15 and generate a swirling flow of the air about a center of the bottom wall part 15. The swirling flow of the air about the center of the bottom wall part 15 changes to a helical flow by receiving kinetic momentum from fine particles of the fuel injected from the nozzle hole 10 and the helical flow of the air transports the fine particles of the fuel.

Advantageous Effects of Invention

According to the invention, the air swirled by the plurality of blades changes to a helical flow of the air by receiving kinetic momentum from fine particles of the fuel injected from the nozzle hole and the helical flow of the air transports the fine particles of the fuel. Therefore, the fine particles of the fuel do not scatter peripherally to reduce the amount of fuel attached to the wall surface of the intake air pipe and the like. Accordingly, in the invention, the utilization efficiency of fuel can be improved.

BRIEF DESCRIPTION OF DRAWINGS

FIG. 2A is a vertical cross sectional view (cross sectional view taken along a line B1-B1 in FIG. 2) illustrating the front end side of the fuel injection device. FIG. 2B is a bottom view (diagram illustrating the front end surface of the fuel injection device seen from a direction A1 in FIG. 2A) illustrating the front end side of the fuel injection device.

FIG. 3A is a front view illustrating the nozzle plate, FIG. 3B is a cross sectional view illustrating the nozzle plate taken along a line B2-B2 in FIG. 3A, FIG. 3C is a cross sectional view illustrating the nozzle plate taken along a line B3-B3 in FIG. 3A, and FIG. 3D is a back view illustrating the nozzle plate according to the embodiment.

FIG. 4A is an enlarged view illustrating part (center part) of a nozzle plate 3 in FIG. 3A, FIG. 4B is a partial enlarged view of the nozzle plate 3 illustrating a nozzle hole 7 and the vicinity of the nozzle hole 7, and FIG. 4C is an enlarged cross sectional view taken along a line B4-B4 in FIG. 4B.

FIG. 5A is a vertical cross sectional view illustrating the injection molding die and FIG. 5B illustrates the cavity inner plane in plan view of a first die against which nozzle hole formation pins abuts.

FIG. 6A is a front view illustrating the nozzle plate according to the modification and this drawing corresponds to FIG. 3A. FIG. 6B is an enlarged view illustrating a central part of the nozzle plate according to the modification and this drawing corresponds to FIG. 4A.

FIG. 7A is a front view illustrating the nozzle plate and this drawing corresponds to FIG. 3A. FIG. 7B is a cross sectional view taken along a line B5-B5 in FIG. 7A. FIG. 7C is a back view illustrating the nozzle plate and this drawing corresponds to FIG. 3D.

FIG. 8A is a cross sectional view illustrating the nozzle plate and this drawing corresponds to FIG. 7B and FIG. 8B is a back view illustrating the nozzle plate and this drawing corresponds to FIG. 7C.

FIG. 9A is a cross sectional view illustrating the nozzle plate and this drawing corresponds to FIG. 7B and FIG. 9B is a back view illustrating the nozzle plate and this drawing corresponds to FIG. 7C.

FIG. 10A illustrates a nozzle plate according to a modification in which two nozzle holes and two orifices are provided and FIG. 10B illustrates a nozzle plat according to a modification in which one nozzle hole and one orifice are provided.

FIGS. 11A-11D illustrate a nozzle plate according to a second embodiment of the invention. FIG. 11A is a front view illustrating the nozzle plate according to the embodiment, FIG. 11B is a cross sectional view illustrating the nozzle plate taken along a line B6-B6 in FIG. 11A, FIG. 11C is a cross sectional view illustrating the nozzle plate taken along a line B7-B7 in FIG. 11A, and FIG. 11D is a back view illustrating the nozzle plate according to the embodiment.

FIG. 12A is an enlarged view illustrating part (center part) of the nozzle plate in FIG. 11A, FIG. 12B is a partial enlarged view of the nozzle plate illustrating a nozzle hole and the vicinity of the nozzle hole, and FIG. 12C is an enlarged cross sectional view taken along a line B8-B8 in FIG. 12B.

FIG. 13A is a vertical cross sectional view illustrating the injection molding die. FIG. 13B illustrates a cavity inner plane in plan view of the first die against which the nozzle hole formation pin abuts.

FIG. 14A is a front view illustrating the nozzle plate and this drawing corresponds to FIG. 11A. FIG. 14B is an enlarged view illustrating a central part of the nozzle plate and this drawing corresponds to FIG. 12A.

FIG. 15A is a front view illustrating the nozzle plate and this drawing corresponds to FIG. 11A. FIG. 15B is a cross sectional view taken along a line B9-B9 in FIG. 15A. FIG. 15C is a back view illustrating the nozzle plate and this drawing corresponds to FIG. 11D.

FIG. 16A is a cross sectional view illustrating the nozzle plate and this drawing corresponds to FIG. 15B and FIG. 16B is a back view illustrating the nozzle plate and this drawing corresponds to FIG. 15C.

FIG. 17A is a cross sectional view illustrating the nozzle plate and this drawing corresponds to FIG. 15B and FIG. 17B is a back view illustrating the nozzle plate and this drawing corresponds to FIG. 15C.

FIG. 18A illustrates a nozzle plate according to a modification in which two nozzle holes and two orifices are provided and FIG. 18B illustrates a nozzle plate according to a modification in which one nozzle hole and one orifice are provided.

FIG. 19A corresponds to FIG. 6A and FIG. 19B corresponds to FIG. 6B.

FIG. 20A corresponds to FIG. 14A and FIG. 20B corresponds to FIG. 14B.

FIG. 21A is a plane view illustrating the central parts of the nozzle plates and FIG. 21B is a cross sectional view taken along a line B10-B10 in FIG. 21A.

FIG. 22A is a front view illustrating the nozzle plate, FIG. 22B is a cross sectional view illustrating the nozzle plate taken along a line B11-B11 in FIG. 22A, and FIG. 22C is a back view illustrating the nozzle plate.

FIG. 24A is a vertical cross sectional view illustrating the injection molding die and FIG. 24B illustrates a cavity inner plane in plan view of the first die against which the nozzle hole formation pin abuts.

FIG. 25A is a cross sectional view illustrating the front end side of the fuel injection device provided with the nozzle plate according to the first conventional example. FIG. 25B is a plan view illustrating the nozzle plate according to the first conventional example. FIG. 25C is an enlarged view (partial plan view of the nozzle plate) illustrating a part D in FIG. 25B. FIG. 25D is a cross sectional view taken along a line B13-B13 in FIG. 25C.

DETAILED DESCRIPTION OF THE INVENTION

Embodiments of the invention will be described in detail below with reference to the drawings.

First Embodiment

Figure 1:
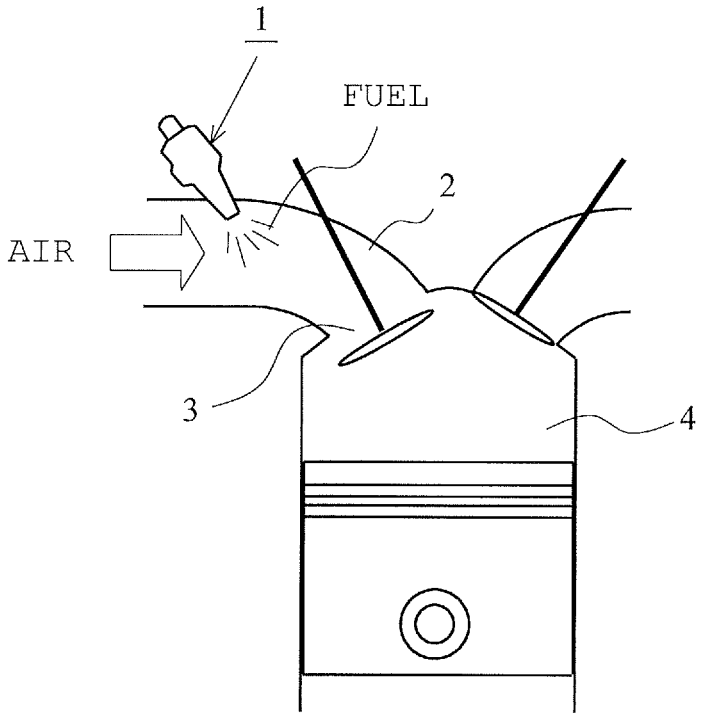
FIG. 1 schematically illustrates the use state of a fuel injection device provided with a fuel injection device nozzle plate according to a first embodiment of the invention.

FIG. 1 schematically illustrates the use of the fuel injection device 1 provided with a fuel injection device nozzle plate according to the first embodiment of the invention. As illustrated in FIG. 1, the fuel injection device 1 of port injection type, which is disposed at a midpoint of the intake air pipe 2 of an engine, injects fuel into the intake air pipe 2, mixes the fuel with air introduced to the intake air pipe 2 to form a combustible gas mixture, and supplies the combustible gas mixture to a cylinder 4 from an intake port 3.

Figure 2A:
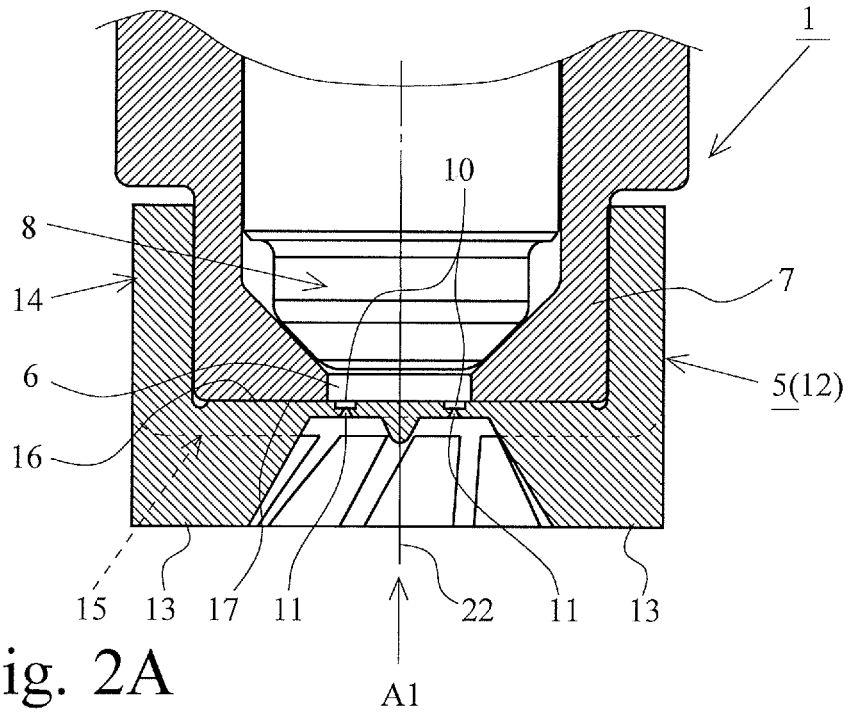
FIGS. 2A-2B illustrate the front end side of the fuel injection device provided with the fuel injection device nozzle plate according to the first embodiment of the invention.
Figure 2B:
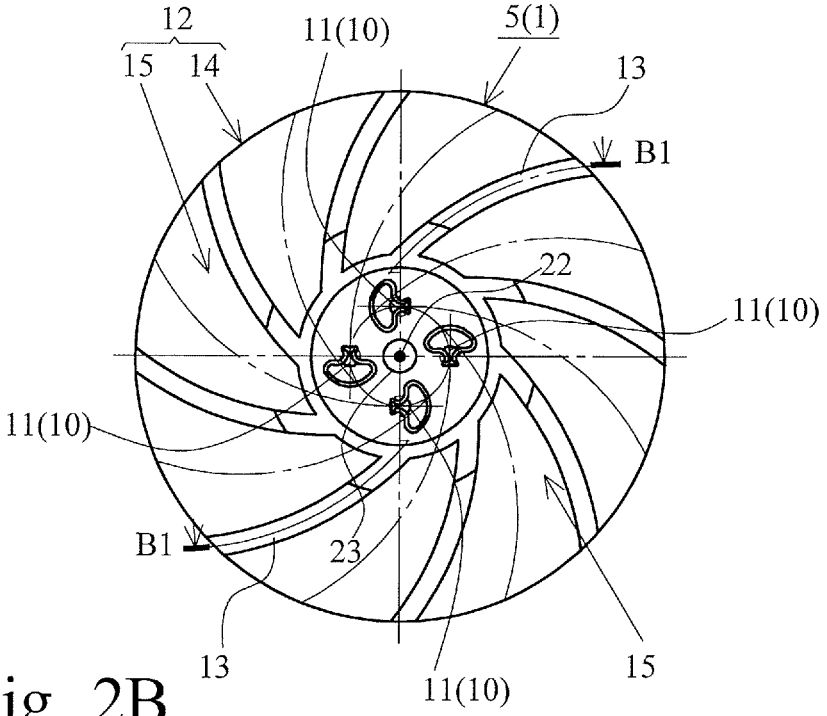

The fuel injection device nozzle plate 5 (referred to below as the nozzle plate) according to the first embodiment of the invention will be described with reference to FIGS. 2 to 4. FIG. 2 illustrates the front end side of the fuel injection device 1 provided with the nozzle plate 5 according to the embodiment. In addition, FIG. 3 illustrates the nozzle plate 5 according to the embodiment. In addition, FIG. 4 is an enlarged view illustrating part of the nozzle plate 5 according to the embodiment.

As illustrated in FIG. 2, the fuel injection device 1 has the nozzle plate 5 attached to the front end side of a valve body 7 in which the fuel injection port 6 is formed. In the fuel injection device 1, a needle valve 8 is opened or closed by a solenoid (not illustrated), fuel in the valve body 7 is injected from the fuel injection port 6 when the needle valve 8 is opened, and the fuel injected from the fuel injection port 6 is injected to the outside through the nozzle holes 10 and orifices 11 of the nozzle plate 5.

As illustrated in FIGS. 2 to 4, the nozzle plate 5 has the plurality of blades 13 formed integrally with a nozzle plate body 12. The nozzle plate body 12 is a bottomed cylindrical body, made of synthetic resin (for example, PPS, PEEK, POM, PA, PES, PEI, LCP), that includes a cylindrical wall part 14 and a bottom wall part 15 formed integrally with one end side of the cylindrical wall part 14. This nozzle plate body 12 is fixed to the valve body 7 in the state in which the cylindrical wall part 14 is fitted onto the outer periphery of the front end side of the valve body 7 without any space and the inner plane 16 of the bottom wall part 15 abuts against a front end surface 17 of the valve body 7. The bottom wall part 15 includes nozzle hole plate portions 18 in which the nozzle holes 10 are opened and an interference body plate portion 21 in which interference bodies 20 are formed. In the interference body plate portion 21, a conical projection 23 having a round tip is formed at the center (the position corresponding to the central axis 22) of the bottom wall part 15 by counter-boring the bottom wall part 15 like a disc around the conical projection 23. In addition, the nozzle hole plate portion 18 has a shape formed by partially counter-boring the periphery of the nozzle hole 10 of the interference body plate portion 21 and the nozzle hole plate portion 18 is thinner than the interference body plate portion 21.

The four nozzle holes 10 are formed at regular intervals about the center (the central axis 22 of the nozzle plate 5) of the bottom wall part 15 so that part of each of the nozzle holes 10 passes through (is opened toward) the front and rear surfaces of the nozzle hole plate portion 18 and the fuel injection port 6 of the valve body 7 communicates with the outside. These nozzle holes 10 are formed so that nozzle hole centers 10*a* are positioned in a center line 24 or 25 (the straight line 24, passing through the central axis 22, that is parallel to the X-axis or the straight line 25, passing through the central axis 22, that is parallel to the Y-axis) of the bottom wall part 15. In addition, the nozzle holes 10 are straight round holes extending orthogonally to the inner plane 16 of the bottom wall part 15 and introduces, from an entrance side opening 26 facing the fuel injection port 6, the fuel injected through the fuel injection port 6 of the valve body 7 and injects the fuel introduced from the entrance side opening 26 from an exit side opening 27 facing the outside (opening through which the fuel flows). The shape of the exit side opening 27 of the nozzle hole 10 is circular.

Figure 4A:
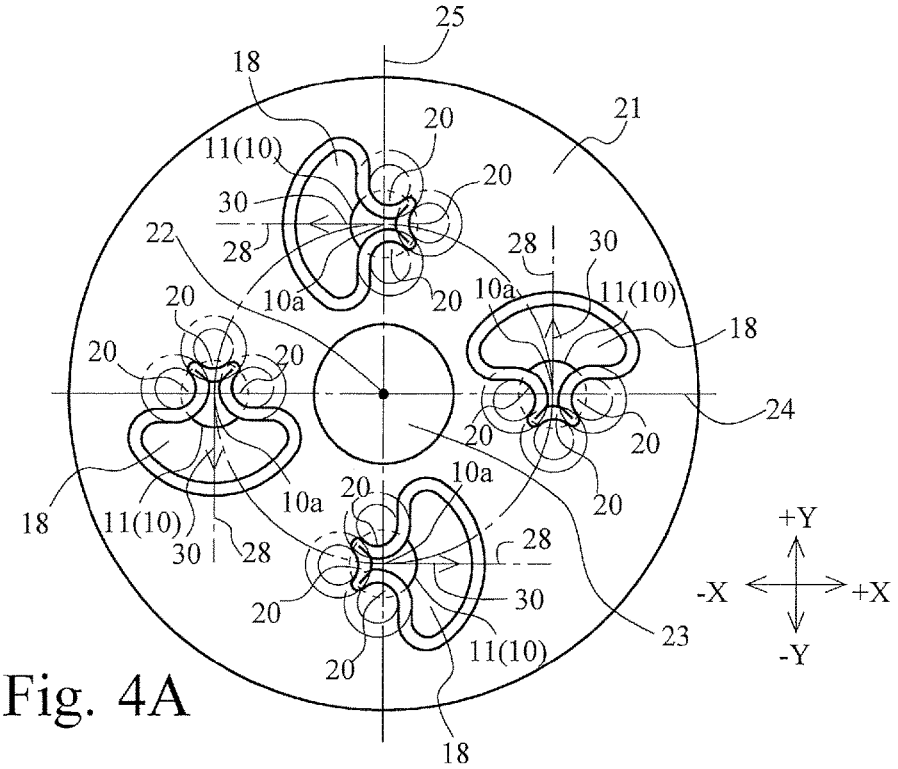
FIGS. 4A-4C are enlarged views illustrating part of the nozzle plate according to the first embodiment of the invention.
Figure 4B:
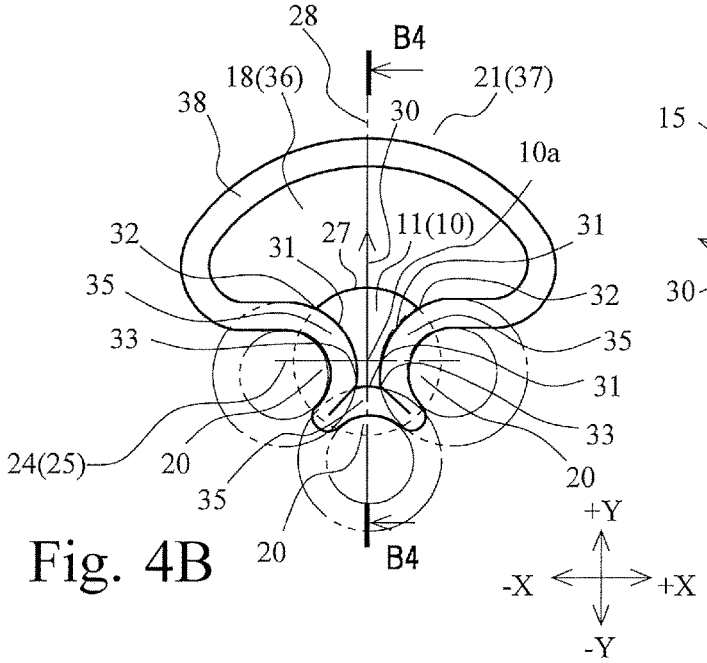
Figure 4C:
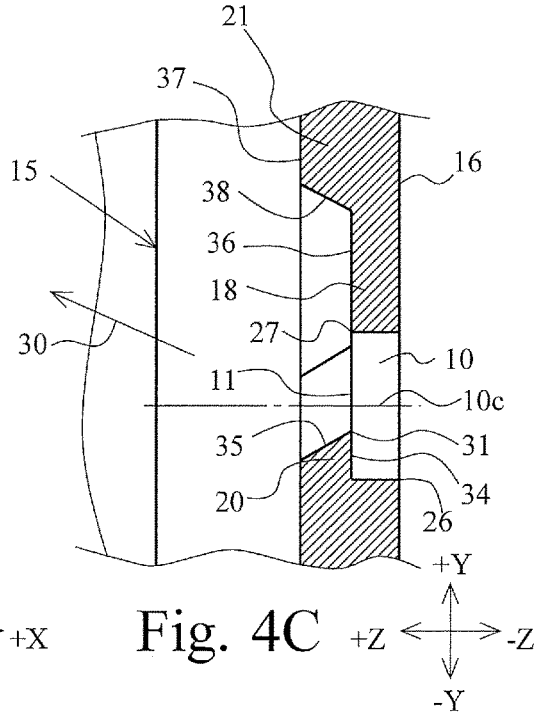

In addition, as illustrated in FIG. 4, the interference body plate portion 21 of the bottom wall part 15 is provided with the three interference bodies 20 partially blocking the nozzle hole 10 for each of the nozzle holes 10. The three interference bodies 20 form the orifice 11 line-symmetric with respect to a straight line 28 orthogonal to the center line 24 (25) passing though the nozzle hole center 10*a* and a center direction 30 of spray injected from the orifice 11 is inclined obliquely with respect to the center axis 10*c* of the nozzle hole 10 (inclined obliquely in the +Y direction FIGS. 4B and 4C) and the center direction 30 of the spray injected from the orifice 11 extends along the straight line 28. The center direction 30 of spray injected from each of the four orifices 11 is the counterclockwise direction about the central axis 22 of the bottom wall part 15. As a result, the spray injected from each of the four orifices 11 generates a counterclockwise swirl flow about the central axis 22.

In addition, as illustrated in detail in FIGS. 4B and 4C, the three interference bodies 20 are formed in the interference body plate portion 21 by partially cutting out a truncated cone and the orifice 11 is formed by partially blocking the nozzle hole 10. A corner portion 32 formed at an intersecting part between an arc-shaped outer edge part 31 of the interference body 20 and the circular exit side opening 27 of the nozzle hole 10 has an acute and sharp shape without roundness and makes the end of the liquid film of fuel passing though the orifice 11 acute and sharp so that the fuel is easily atomized by friction with air. In addition, a corner portion 33 formed the abutting part (intersecting part) between the arc-shaped outer edge part 31 of the interference body 20 and the arc-shaped outer edge part 31 of the interference body 20 has an acute and sharp shape without roundness and makes the end of the liquid film of fuel passing though the orifice 11 acute and sharp so that the fuel is easily atomized by friction with air. Although the corner portion 32 is formed at the intersecting part between the arc-shaped outer edge part 31 of the interference body 20 and the circular exit side opening 27 of the nozzle hole 10 in the nozzle plate 5 according to the embodiment, the invention is not limited to the embodiment and the acute corner portion 32 without roundness may be formed by a linear outer edge part of the interference body 20 and an arc-shaped exit side opening 27 of the nozzle hole 10.

In addition, as illustrated in FIG. 4, the interference body 20 partially blocks the exit side opening 27 of the nozzle hole 10 and is provided with a fuel collision surface 34 positioned orthogonally to the central axis 10*c* of the nozzle hole 10 and a side surface (inclined plane) 35 intersecting the fuel collision surface 34 at an acute angle. The fuel collision surface 34 of the interference body 20 is formed so that the fuel collision surface 34 and an outer surface 36 (the surface opposite to the inner plane 16) of the nozzle hole plate portion 18 are present on a single plane. The side surface 35 of the interference body 20 is smoothly connected to a side surface (inclined plane) 38 connecting the outer surface 36 of the nozzle hole plate portion 18 to an outer surface 37 of the interference body plate portion 21. In addition, the side surface 38 connecting the outer surface 36 of the nozzle hole plate portion 18 to the outer surface 37 of the interference body plate portion 21 is formed away from the exit side opening 27 of the nozzle hole 10 so as to keep the same distance from the exit side opening 27 of the nozzle hole 10 opened toward the nozzle hole plate portion 18 to prevent interference with spray injected from the nozzle hole 10. In the embodiment, the side surface 38 connecting the outer surface 36 of the nozzle hole plate portion 18 to the outer surface 37 of the interference body plate portion 21 and the side surface 35 of the interference body 20 are formed at the same inclination angle so as to easily machine an injection molding die.

In addition, as illustrated in FIG. 3, on the outer plane 40 (the surface opposite to the inner plane 16) of the bottom wall part 15, the eight blades 13 with the same shape are formed at regular intervals about the central axis 22 integrally with the outer plane 40 so as to be positioned radially outward of the interference body plate portion 21. This blade 13 is arc-shaped in plan view and has a constant thickness from the radially inward end to the radially outward end. In addition, the blades 13 is cut obliquely upward from the radially inward end so as not to obstruct spray injected from the orifice 11 and a fuel collision prevention part 41 is formed to obtain a space large enough to prevent the spray state of fuel injected from the orifice 11 from being affected. In addition, the blade 13 has the same blade height except the fuel collision prevention part 41 close to the radially inward end. The spacing between the pair of blades 13 and 13 adjacent to each other is reduced from radially outward to radially inward and a blade groove 42 between the blades 13 is narrowed from radially outward to radially inward.

Figure 3B:
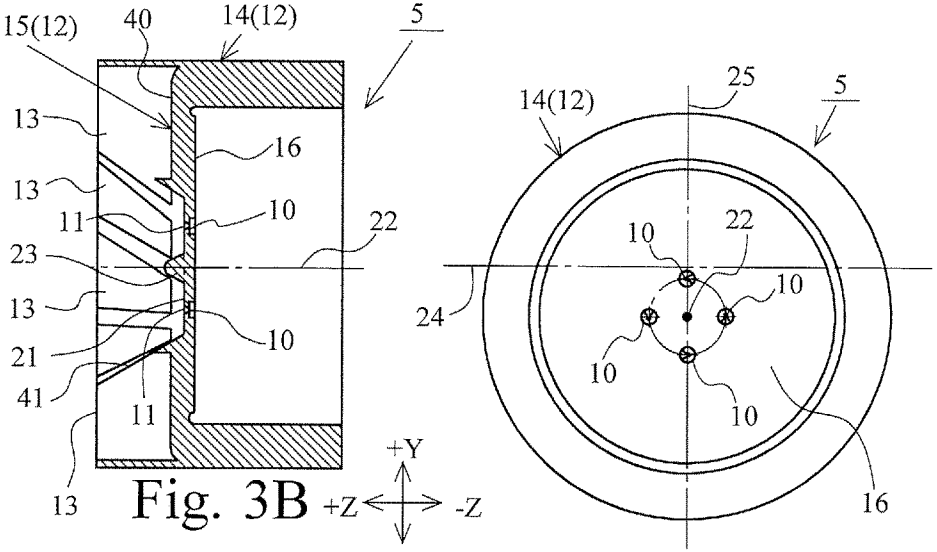
FIGS. 3A-3D illustrate the nozzle plate according to the first embodiment of the invention.
Figure 3D:
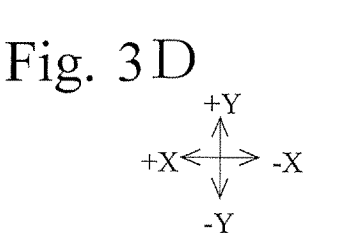
Figure 3C:
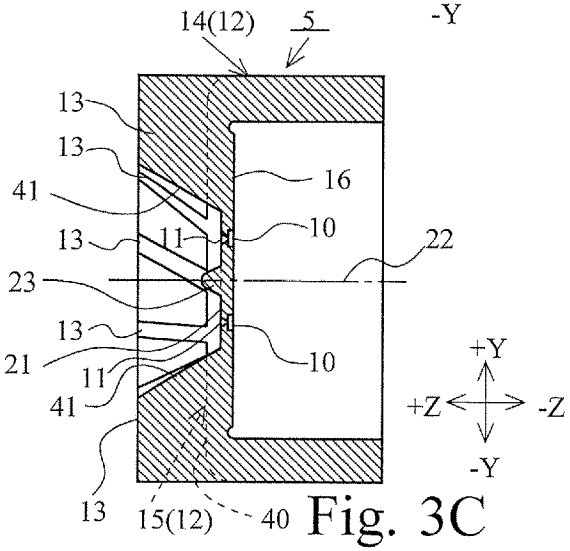
Figure 3A:
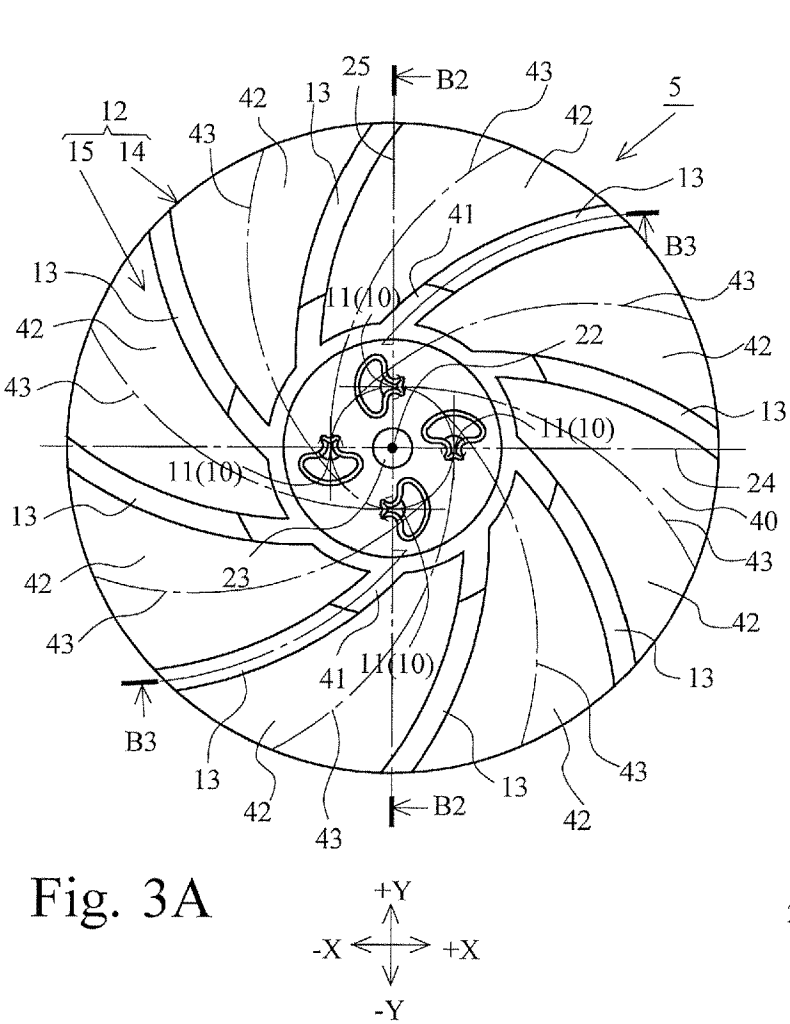

As illustrated in FIG. 3A, in the blade 13, the radially outward end is displaced clockwise (right rotation direction) from the radially inward end. When an air flow from the radially outward end to the radially inward end is generated, this air flow interacts with an air flow generated by another adjacent blade 13 to generate a counterclockwise swirl flow about the central axis 22 of the bottom wall part 15.

In FIG. 3A, on the basis of the central axis 22 of the bottom wall part 15, the nozzle hole 10 having its center in the center line 24 extending in the +X-axis direction is assumed to be the first nozzle hole 10 and the nozzle holes 10 displaced counterclockwise by a multiple of 90 degrees from the first nozzle hole 10 are assumed to be the second to fourth nozzle holes 10. In addition, in FIG. 3A, when the central axis 22 of the bottom wall part 15 is the center of the X-Y coordinate plate of an orthogonal coordinate system, the blade groove 42 having its radially inward end in a position close to the +X-axis in the first quadrant is assumed to be the first blade groove 42 and the blade grooves 42 displaced counterclockwise by a multiple of 45 degrees from the first blade groove 42 are assumed to be the second to eighth blade grooves 42. In FIG. 3A described above, the center line 43 of the first blade groove 42 passes through the center of the second nozzle hole 10. The center line 43 of the third blade groove 42 passes through the center of the third nozzle hole 10. The center line 43 of the fifth blade groove 42 passes through the center of the fourth nozzle hole 10. The center line 43 of the seventh blade groove 42 passes through the center of the first nozzle hole 10. The center line 43 of the second blade groove 42 passes through the vicinity of the second nozzle hole 10. The center line 43 of the fourth blade groove 42 passes through the vicinity of the third nozzle hole 10. The center line 43 of the sixth blade groove 42 passes through the vicinity of the fourth nozzle hole 10. The center line 43 of the eighth blade groove 42 passes through the vicinity of the first nozzle hole 10. The center lines 43 of the first to eighth blade grooves 42 pass about (around the conical projection 23) of the central axis 22 of the bottom wall part 15.

Figure 5A:
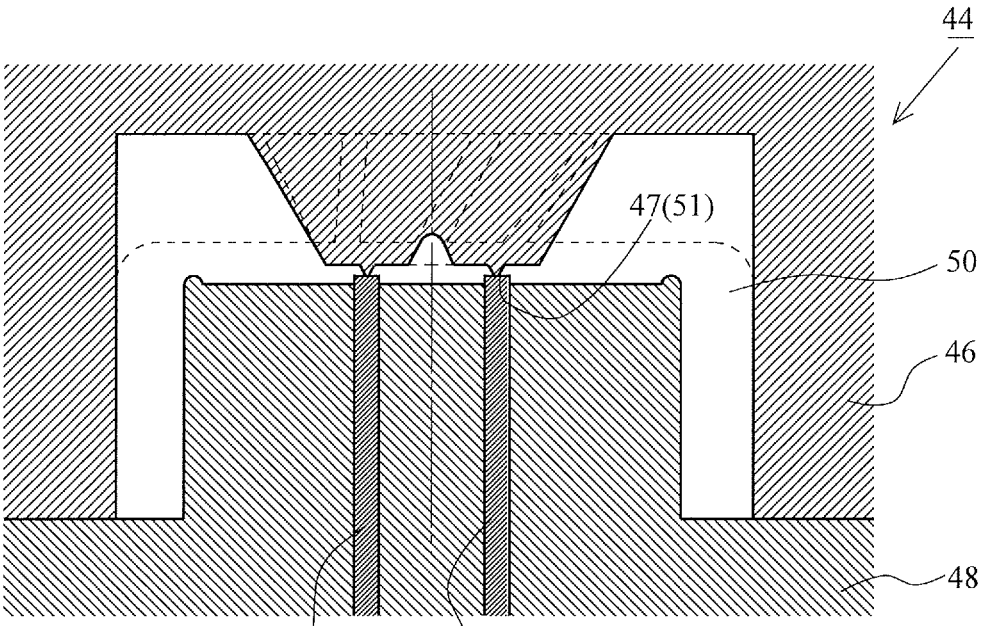
FIGS. 5A-5B are structural diagrams illustrating an injection molding die used for injection molding of the nozzle plate according to the first embodiment of the invention.
Figure 5B:
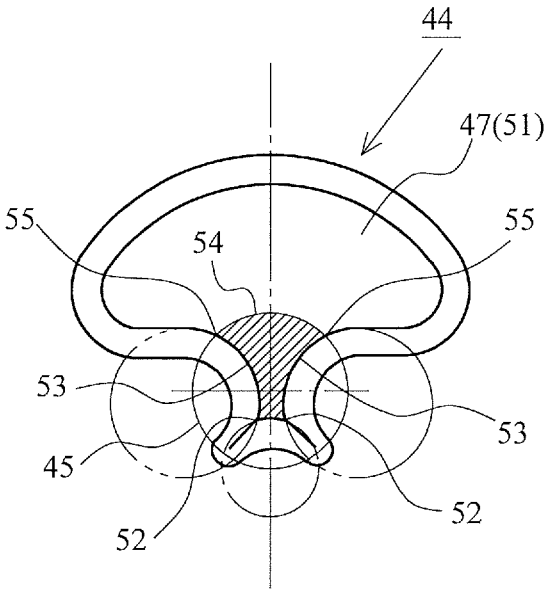

FIG. 5 is a structural diagram illustrating an injection molding die 44 used for injection molding of the nozzle plate 5. FIG. 5A is a vertical cross sectional view illustrating the injection molding die 44. In addition, FIG. 5B illustrates a cavity inner plane 47 of a first die 46 against which a nozzle hole formation pin 45 abuts in plan view.

As illustrated in FIG. 5, in the injection molding die 44, a cavity 50 is formed between the first die 46 and a second die 48 and the nozzle hole formation pins 45 for forming the nozzle holes 10 project into the cavity 50 (see particularly FIG. 5A). The tip of the nozzle hole formation pin 45 abuts against the cavity inner plane 47 of the first die 46 (see the shaded area in FIG. 5B). The part of the first die 46 against which the nozzle hole formation pin 45 abuts is a convex part 51 for forming the nozzle hole plate portion 18 and the orifice 11. The contour of the convex part 51 of the cavity inner plane 47 is easily machined by a machining tool having the same inclination angle as in the side surface 35 of the interference body 20 and the intersecting part of the movement paths of the machining tool is an acute and sharp corner portion 52 without roundness. The corner portions 52 formed in the convex parts 51 of the cavity inner plane 47 shape the corner portions 33 in the abutting parts (intersecting parts) between the arc-shaped outer edge part 31 of the interference body 20 and the arc-shaped outer edge part 31 of the interference body 20. In addition, the intersecting parts between front end side outer edges 53 of the convex parts 51 of the cavity inner plane 47 and the front end side outer edge 54 of the nozzle hole formation pin 45 are acute and sharp corner portions 55 without roundness. The corner portions 55 formed at the intersecting parts between the front end side outer edges 53 of the convex part 51 of the cavity inner plane 47 and the front end side outer edge 54 of the nozzle hole formation pin 45 shape the corner portions 32 in the intersecting parts between the arc-shaped outer edge parts 31 of the interference bodies 20 and the circular exit side opening 27 of the nozzle hole 10.

In the injection molding die 44 described above, when molten resin (molten material) is injected from a gate (not illustrated) into the cavity 50 and the molten resin in the cavity 50 is cooled and solidified, the nozzle plate 5 having the plurality of blades 13 integrated with the nozzle plate body 12 is formed (see FIGS. 2 and 3). In addition, in the nozzle plate 5 injection molded by the injection molding die 44 described above, the fuel collision surface 34 of the interference body 20 and the outer surface 36 of the nozzle hole plate portion 18 are present on a single plane, the acute and sharp corner portions 32 without roundness are formed at the opening edge of the orifice 11, and the acute and sharp corner portions 33 without roundness are formed in the abutting parts (intersecting parts) between the arc-shaped outer edge part 31 of the interference body 20 and the arc-shaped outer edge part 31 of the interference body 20. The nozzle plate 5 including the bottom wall part 15, the cylindrical wall part 14, and the blades 13 injection molded as described above to have a monolithic one-piece construction has higher efficiency than nozzle plates formed by etching or discharge machining, thereby achieving reduction in the product unit price.

In the nozzle plate 5 configured as described above, since the pressures of the exit side peripheral portions of the orifices 11 are reduced (lower than the atmospheric pressure) when fuel is injected from the orifices 11, the air around the nozzle plate 5 flows (is drawn) from the radially outward end to the radially inward end of the first to eighth blade grooves 42 and the air flows from the radially inward end of the first to eighth blade grooves 42 to the center of the nozzle hole 10 or the vicinity of the nozzle hole 10. That is, the air from the radially inward end of the first to eighth blade grooves 42 flows about the central axis 22 of the bottom wall part 15 with a predetermined distance (at least the distance corresponding to the shape of the conical projection 23) away from the central axis 22, thereby causing a counterclockwise swirl flow about the central axis 22 of the bottom wall part 15. In addition, atomized droplets (fine particles of fuel) in the spray have kinetic momentum (counterclockwise speed component), draw peripheral air and air swirling around the periphery, and provide the drawn air with kinetic momentum. The air having kinetic momentum flows helically and transports the droplets (fine particles of fuel). The droplets (fine particles of fuel) in the spray are prevented from scattering peripherally because they are transported by the helical air flow. Accordingly, the nozzle plate 5 according to the embodiment can reduce the amount of fuel attached to the wall surface of the intake air pipe 2 and the like, thereby improving the utilization efficiency of fuel (see FIG. 1).

In addition, in the nozzle plate 5 according to the embodiment, since the eight blades 13 are formed at regular intervals about the central axis 22 integrally with the bottom wall part 15 so as to be positioned radially outward of the interference body plate portion 21, the blades 13 can prevent a tool or the like from colliding with the nozzle hole 10 and its periphery when the nozzle plate 5 is assembled to the valve body 7 and the blades 13 can prevent the nozzle hole 10 of the bottom wall part 15 and its peripheral portions from being damaged. In addition, in the nozzle plate 5 according to the embodiment, when the fuel injection device 1 having the nozzle plate 5 assembled to the valve body 7 is assembled to the intake air pipe 2 of the engine, the blades 13 can prevent engine components and the like from colliding with the nozzle hole 10 and its periphery and the blades 13 can prevent the nozzle hole 10 of the bottom wall part 15 and its peripheral portions from being damaged.

In the nozzle plate 5 according to the embodiment, part of fuel injected from the fuel injection port 6 of the fuel injection device 1 collides with the fuel collision surface 34 of the interference body 20 and is atomized, the flow of the fuel is steeply bent by the fuel collision surface 34, the bent flow collides with the fuel attempting to pass straight through the nozzle hole 10 and the orifice 11, and the flow of the fuel attempting to pass straight through the nozzle hole 10 and the orifice 11 is disturbed. In addition, the nozzle plate 5 according to the embodiment has the acute and sharp corner portions 32 and 33 without roundness at the opening edge of the orifice 11 and the opening edge of the orifice 11 is narrowed toward the corner portions 32 and 33. As a result, in the nozzle plate 5 according to the embodiment, of the fuel injected from the orifice 11, the liquid film of the fuel injected from the corner portions 32 and 33 of the orifice 11 and the vicinity of the corner portions 32 and 33 becomes thin and acutely sharp, thereby facilitating the atomization of the fuel injected from the corner portions 32 and 33 of the orifice 11 and the vicinity of the corner portions 32 and 33 by friction with air in the vicinity of the orifice 11. In the nozzle plate 1002 according to the first conventional example, since an entrance side nozzle hole part 1003*a* positioned close to the fuel injection port 1001 of the fuel injection device 1000 and an exit side nozzle hole part 1003*b* positioned on the downstream side in the fuel injection direction of the entrance side nozzle hole part 1003*a* are machined by etching, corner parts 1007 of the exit side nozzle hole part 1003*b* are rounded. As a result, in the nozzle plate 1002 according to the first conventional example, the fuel injected from the nozzle hole 1003 does not easily become an acute liquid film, thereby making the atomization of the fuel by friction with air insufficient. As compared with the nozzle plate 1002 according to the first conventional example as described above, the nozzle plate 5 according to the embodiment further improves the degree of atomization of the fuel injected from the orifice 11.

In the nozzle plate 5 according to the embodiment, since the side surface 35 of the interference body 20 is formed to intersect the fuel collision surface 34 of the interference body 20 at an acute angle and an air layer is generated between the fuel passing through the orifice 11 and the side surface 35 of the interference body 20, the fuel passing through the orifice 11 is likely to draw air, thereby promoting the atomization of the fuel passing though the orifice 11.

(Modification 1 of First Embodiment)

Figure 6A:
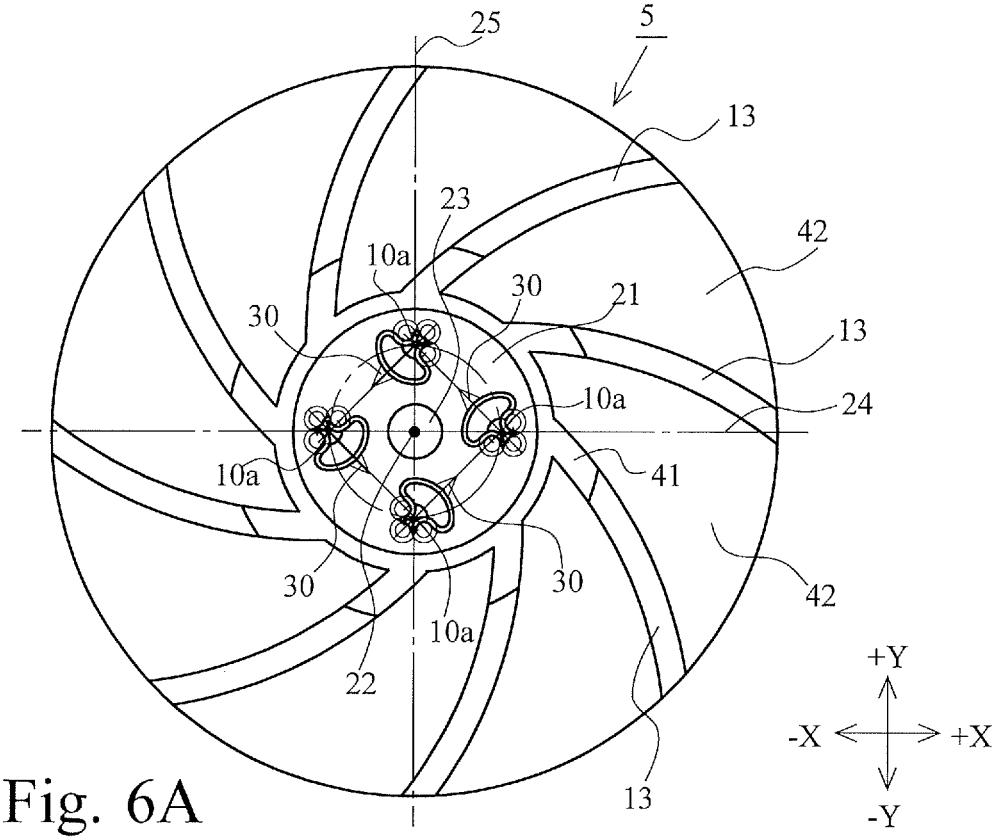
FIGS. 6A-6B illustrate a nozzle plate according to modification 1 of the first embodiment of the invention.
Figure 6B:
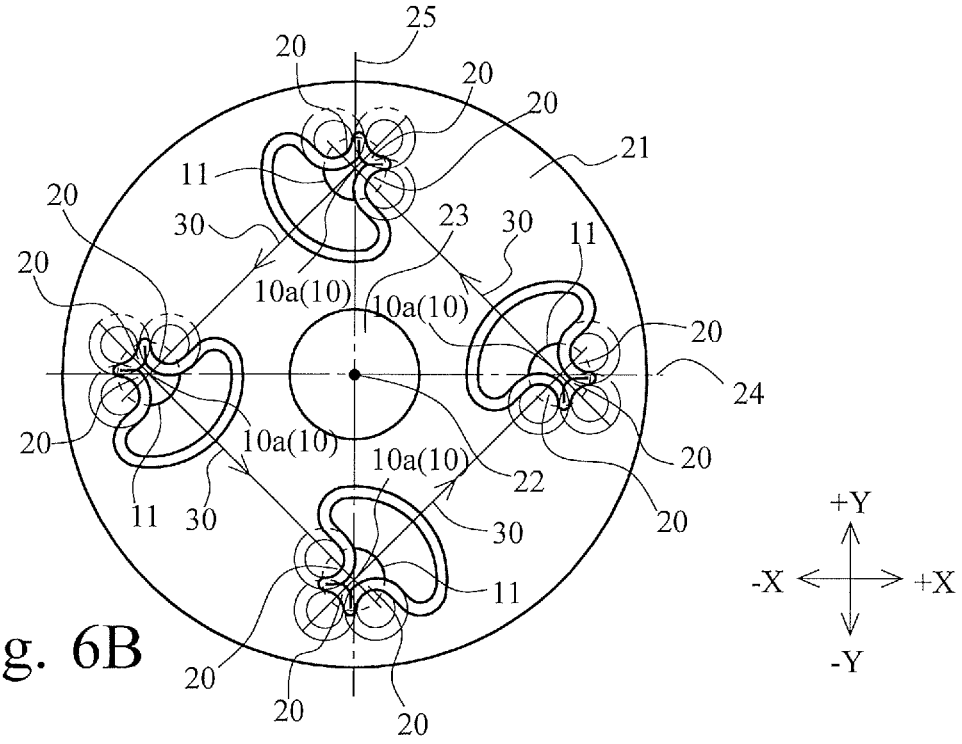

FIG. 6 illustrates the nozzle plate 5 according to modification 1 of the first embodiment of the invention. FIG. 6A is a front view illustrating the nozzle plate 5 and this drawing corresponds to FIG. 3A. FIG. 6B is an enlarged view illustrating a central part of the nozzle plate 5 and this drawing corresponds to FIG. 4A.

In the nozzle plate 5 according to the modification, the three interference bodies 20 are formed for each nozzle hole 10 so that the center direction 30 of spray injected from each of the orifices 11 is oriented to the nozzle hole center 10*a* of another adjacent nozzle hole 10 (positioned on the front side along the fuel injection direction). That is, the nozzle plate 5 according to the modification is formed by rotating the orifices 11 of the nozzle plate 5 according to the first embodiment counterclockwise about the nozzle hole centers 10*a* by 45 degrees and displacing the four nozzle holes 10 and the four orifices 11 of the nozzle plate 5 according to the first embodiment radially outward of the central axis 22 of the bottom wall part 15.

In the nozzle plate 5 according to the modification formed as described above, as compared with the nozzle plate 5 according to the first embodiment, effects of spray from the adjacent orifices 11 are large, the air swirled by a plurality of blades 13 receives more kinetic momentum in the swirl direction from fine particles of the fuel in spray and a stronger helical air flow is formed.

(Modification 2 of First Embodiment)

Figure 7C:
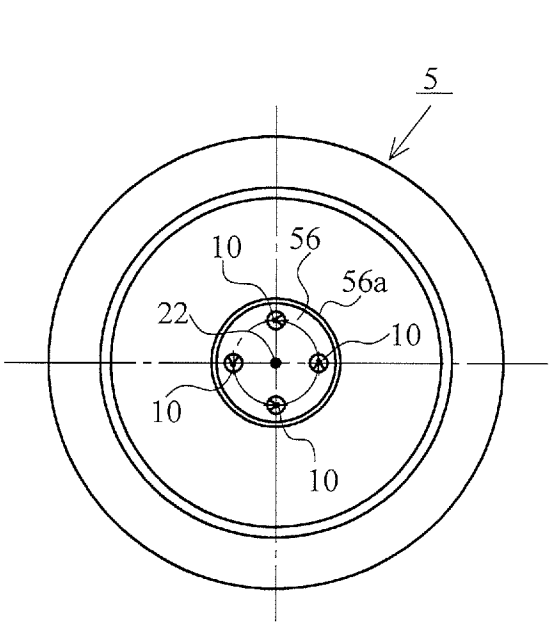
FIGS. 7A-7C illustrate a nozzle plate according to modification 2 of the first embodiment of the invention.
Figure 7B:
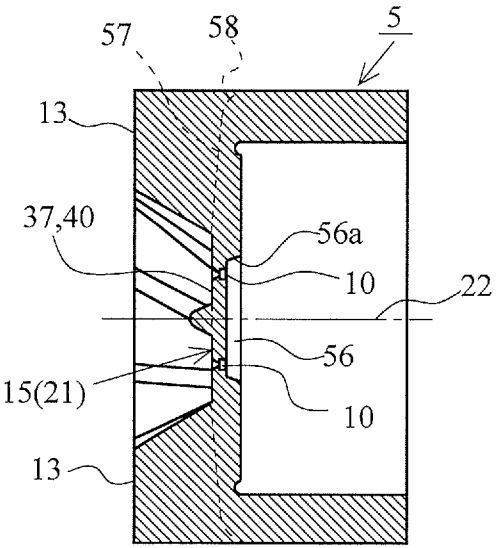
Figure 7A:
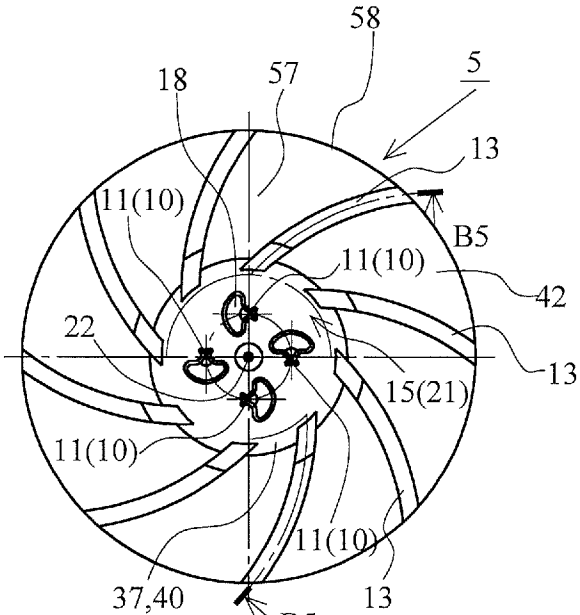

FIG. 7 illustrates the nozzle plate 5 according to modification 2 of the first embodiment of the invention. FIG. 7A is a front view illustrating the nozzle plate 5 and this drawing corresponds to FIG. 3A. In addition, FIG. 7B is a cross sectional view taken along the line B5-B5 in FIG. 7A. In addition, FIG. 7C is a back view illustrating the nozzle plate 5 and this drawing corresponds to FIG. 3D.

In the nozzle plate 5 according to the modification, the outer surface 37 of the interference body plate portion 21 and the outer plane 40 of the bottom wall part 15 are present on a single plane and there is a difference from the nozzle plate 5 according to the first embodiment in which the interference body plate portion 21 is formed by counter-boring the bottom wall part 15 like a disc. In addition, in the nozzle plate 5 according to the modification, a bottomed round hole 56 is formed on the back of the bottom wall part 15 to make the thickness of the nozzle hole plate portion 18 and the thickness of the interference body plate portion 21 identical to those in the nozzle plate 5 according to the first embodiment. The four nozzle holes 10 are opened in the bottom of the round hole 56. The side surface 56*a* of the round hole 56 is positioned so as to surround the four nozzle holes 10.

In addition, in the nozzle plate 5 according to the modification, the bottom wall part 15 is obliquely cut from the position slightly radially outward of the radially inward end of the blade 13 toward the radially outward end to form a hollow-disc-shaped inclined plane 57. The radially outward end of the hollow-disc-shaped inclined plane 57 is rounded as a smoothly curved surface 58. As a result, the nozzle plate 5 according to the modification can widely and smoothly introduce air around the blade groove 42 in the blade groove 42 as compared with the nozzle plate 5 according to the first embodiment. In addition, since the outer surface 37 of the interference body plate portion 21 and the outer plane 40 of the bottom wall part 15 are present on a single plane as described above in the nozzle plate 5 according to the modification, as compared with the nozzle plate 5 according to the first embodiment in which the interference body plate portion 21 is formed by counter-boring the bottom wall part 15 like a disc, the air flowing from the radially inward end of the blade groove 42 to the interference body plate portion 21 is not easily affected by the recessed portion, thereby increasing the speed of the air flowing from the radially inward end of the blade groove 42 to the orifice 11.

In the nozzle plate 5 according to the modification configured as described above, since the speed of the air flowing from the radially inward end of the blade groove 42 to the orifice 11 is larger than in the nozzle plate 5 according to the first embodiment, if the air flowing from the radially inward end of the blade groove 42 to the orifice 11 receives kinetic momentum from fine particles in the sprayed fuel, a stronger helical air flow is formed.

(Modification 3 of First Embodiment)

Figure 8A:
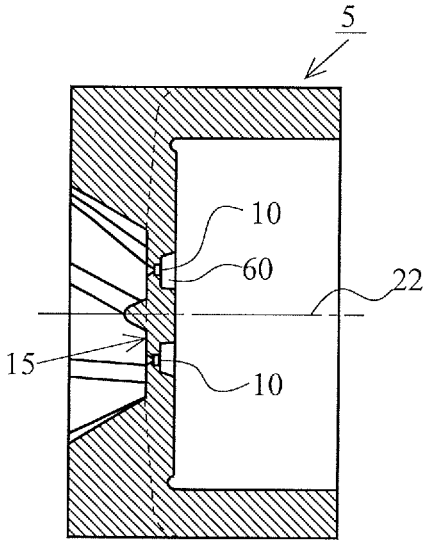
FIGS. 8A-8B illustrate a nozzle plate according to modification 3 of the first embodiment of the invention and illustrates a modification of the nozzle plate according to modification 2.
Figure 8B:
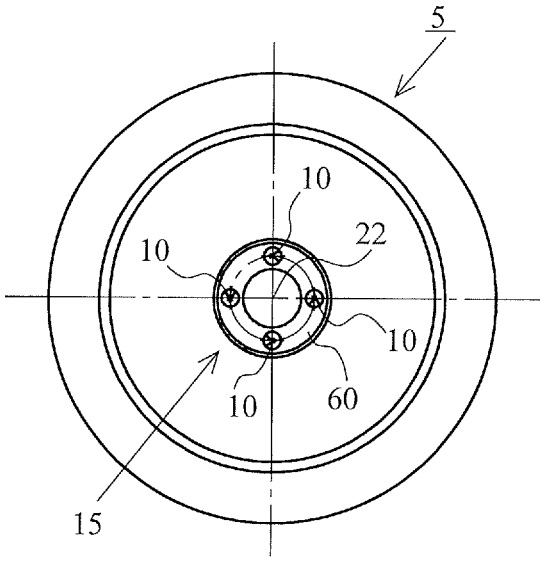

FIG. 8 illustrates the nozzle plate 5 according to modification 3 of the first embodiment of the invention and illustrates a modification of the nozzle plate 5 according to modification 2. FIG. 8A is a cross sectional view illustrating the nozzle plate 5 and this drawing corresponds to FIG. 7B and FIG. 8B is a back view illustrating the nozzle plate 5 and this drawing corresponds to FIG. 7C.

In the nozzle plate 5 according to the modification illustrated in FIG. 8, the round hole 56 formed on the back surface of the bottom wall part 15 of the nozzle plate 5 according to modification 2 is replaced with a ring-shaped hole 60 so that the amount of fuel stored in the hole 60 is less than the amount of fuel stored in the round hole 56.

(Modification 4 of First Embodiment)

Figure 9A:
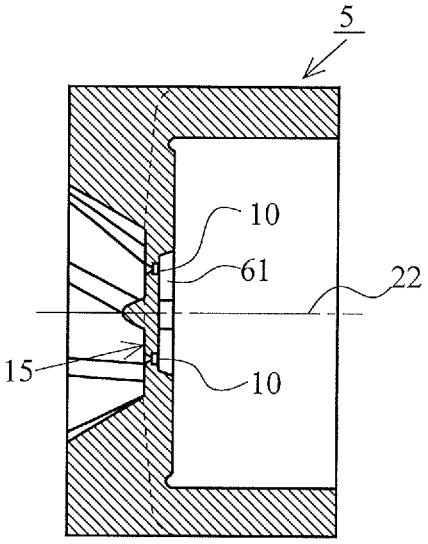
FIGS. 9A-9B illustrate a nozzle plate according to modification 4 of the first embodiment of the invention and illustrates a modification of the nozzle plate a according to modification 2.
Figure 9B:
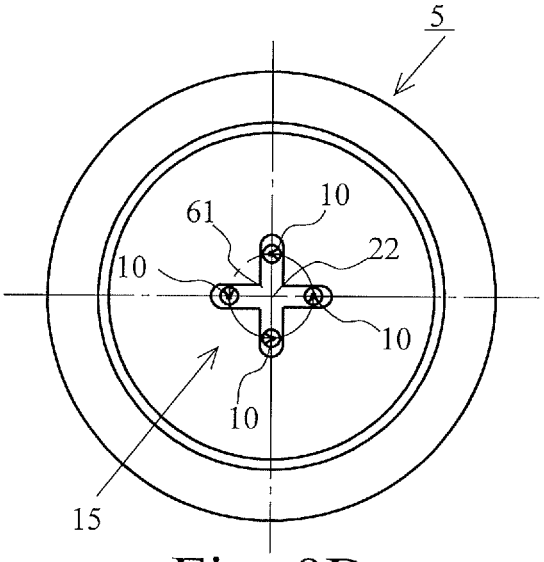

FIG. 9 illustrates the nozzle plate 5 according to modification 4 of the first embodiment of the invention and illustrates a modification of the nozzle plate 5 according to modification 2. FIG. 9A is a cross sectional view illustrating the nozzle plate 5 and this drawing corresponds to FIG. 7B and FIG. 9B is a back view illustrating the nozzle plate 5 and this drawing corresponds to FIG. 7C.

In the nozzle plate 5 according to the modification illustrated in FIG. 9, the round hole 56 formed on the back surface of the bottom wall part 15 of the nozzle plate 5 according to modification 2 is replaced with a crisscross hole 61 so that the amount of fuel stored in the hole 61 is less than the amount of fuel stored in the round hole 56.

(Other Modifications of First Embodiment)

Figure 10B:
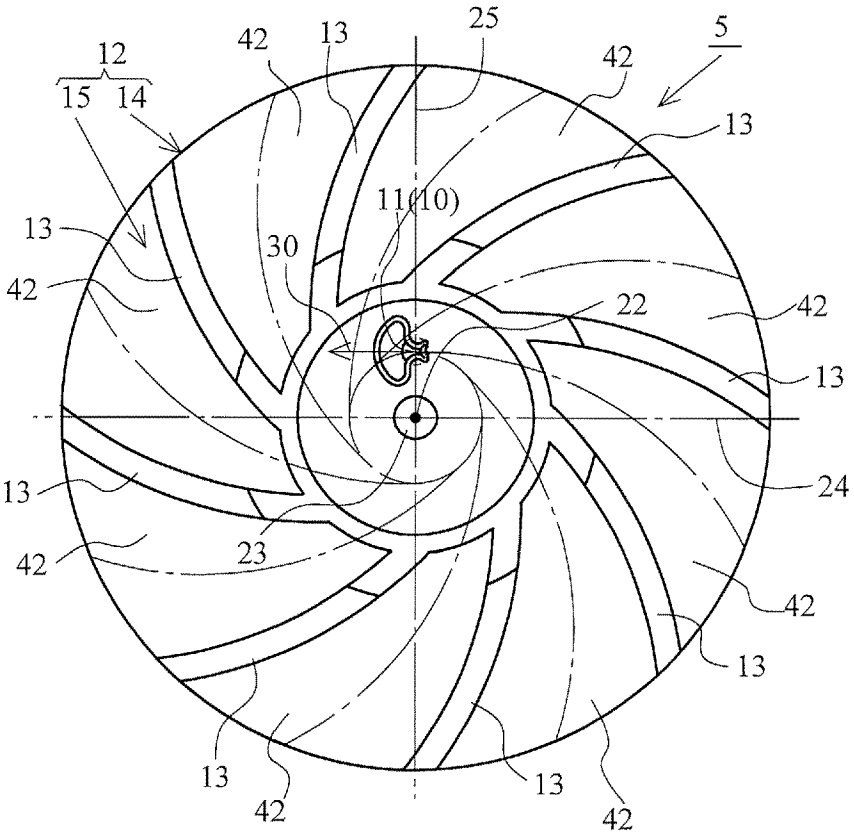
FIGS. 10A-10B illustrate nozzle plates according to other modifications of the first embodiment of the invention.
Figure 10A:
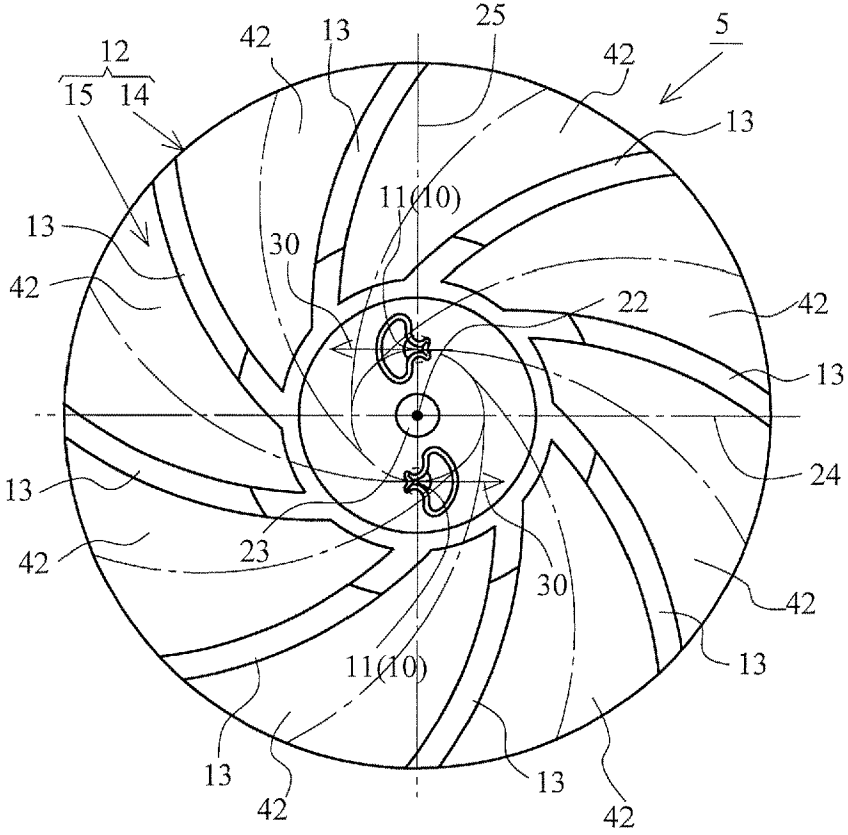

In the nozzle plate 5 according to the first embodiment of the invention, the four nozzle hole 10 and the four orifices 11 are formed at regular intervals about the central axis 22 of the bottom wall part 15. However, the invention is not limited to the embodiment and the two nozzle holes 10 and the two orifices 11 may be formed at regular intervals about the central axis 22 of the bottom wall part 15 as illustrated in FIG. 10A. In addition, as illustrated in FIG. 10B, one nozzle hole 10 and one orifice 11 may be formed in the bottom wall part 15. In FIGS. 10A and 10B, the center direction 30 of the fuel injected from the orifice 11 is oriented counterclockwise and the flow of air flowing in via the blade groove 42 generates a counterclockwise swirl flow.

In addition, in the nozzle plates 5 according to the first embodiment and the modifications of the first embodiment, the four nozzle holes 10 are formed and twice as many (eight) blades 13 as the nozzle holes 10 are provided. However, the invention is not limited to the embodiment and the modifications and the plurality of (two or more) nozzle holes 10 may be formed and twice as many blades 13 as nozzle holes 10 may be provided. In addition, in the nozzle plates 5 according to the first embodiment and the modifications of the first embodiment, twice as many blade grooves 42 as the nozzle holes 10 are provided. However, the invention is not limited to the embodiment and the modifications and as many blade groove 42 as the nozzle holes 10 may be provided. In addition, in the nozzle plates 5 according to the first embodiment and the modifications of the first embodiment, twice as many blade grooves 42 as the nozzle holes 10 are formed. However, the invention is not limited to the embodiment and the modifications and a number of the blade grooves 42 equal to a multiple of the number of the nozzle holes 10 may be provided.

In addition, in the nozzle plates 5 according to the first embodiment and the modifications of the first embodiment, the shapes (right hand helix shapes) of the orifice 11 and the blade 13 are determined so as to generate a counterclockwise swirl flow about the central axis 22 of the bottom wall part 15. However, the invention is not limited to the first embodiment and the modifications of the first embodiment and the shapes of the orifice 11 and the blade 13 (left hand helix shapes) may be determined so as to generate a clockwise swirl flow about the central axis 22 of the bottom wall part 15.

In addition, in the nozzle plates 5 according to the first embodiment and the modifications of the first embodiments, the blade 13 is arc-shaped in plan view (see FIG. 3A). However, the invention is not limited to the first embodiment and the modifications of the first embodiment and the blade 13 may be linear in plan view.

In addition, in the nozzle plates 5 according to the first embodiment and the modifications of the first embodiment, when a swirl flow can be generated by the plurality of blades 13, the conical projection 23 may be omitted as appropriate.

Second Embodiment

Figure 12A:
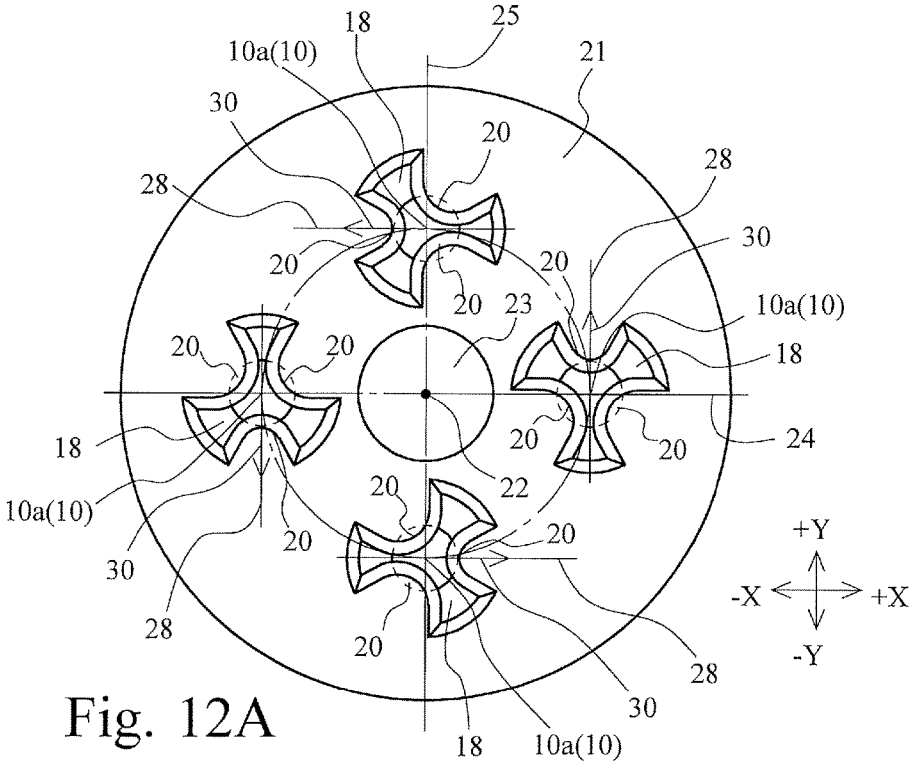
FIGS. 12A-12C are enlarged views illustrating part of the nozzle plate according to the second embodiment of the invention.
Figure 12B:
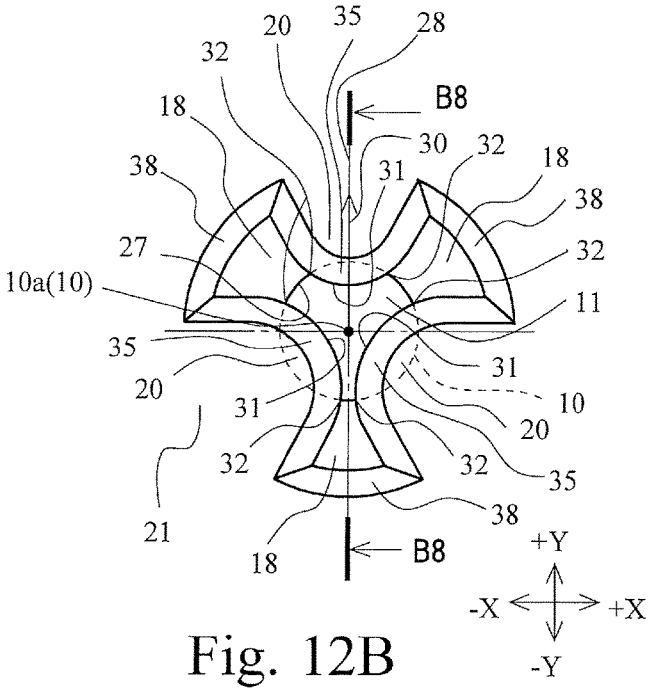
Figure 12C:
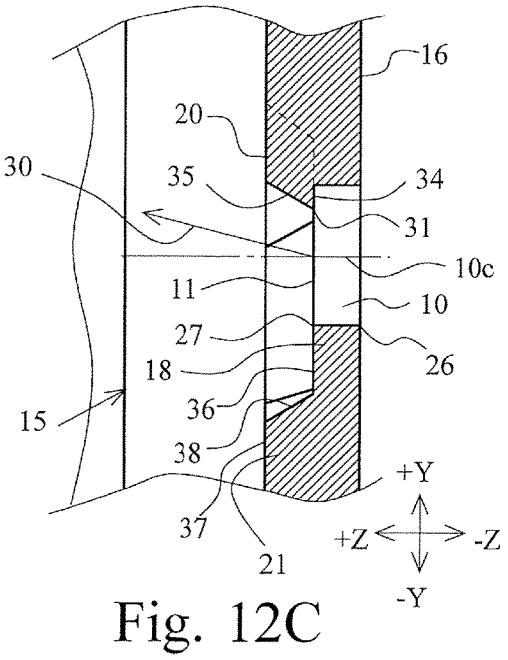

FIGS. 11 and 12 illustrate the nozzle plate 5 according to the second embodiment of the invention. FIG. 11A is a front view illustrating the nozzle plate 5 according to the embodiment. FIG. 11B is a cross sectional view of the nozzle plate 5 taken along the line B6-B6 in FIG. 11A, FIG. 11C is a cross sectional view of the nozzle plate 5 taken along the line B7-B7 in FIG. 11A, and FIG. 11D is a back view illustrating the nozzle plate 5 according to the embodiment. In addition, FIG. 12A is an enlarged view illustrating part (central part) of the nozzle plate 5 in FIG. 11A, FIG. 12B is a partial enlarged view illustrating the nozzle hole 10 and the vicinity of the nozzle hole 10 of the nozzle plate 5, and FIG. 12C is an enlarged cross sectional view taken along the line B8-B8 in FIG. 12B.

In the nozzle plate 5 according to the embodiment illustrated in FIGS. 11 and 12, the plurality of blades 13 are injection molded integrally with the nozzle plate body 12, as in the nozzle plate 5 according to the first embodiment. In addition, the nozzle plate body 12 according to the embodiment is a bottomed cylindrical body, made of synthetic resin material (for example, PPS, PEEK, POM, PA, PES, PEI, LCP), that includes the cylindrical wall part 14 and the bottom wall part 15 on one end side of the cylindrical wall part 14 as in the nozzle plate body 12 according to the first embodiment. In addition, the nozzle plate 5 is fixed to the valve body 7 in the state in which the nozzle plate body 12 and the cylindrical wall part 14 are fitted onto the front end side outer periphery of the valve body 7 without any space and the inner plane 16 of the bottom wall part 15 abuts against the front end surface 17 of the valve body 7 (see FIG. 2).

The bottom wall part 15 includes the nozzle hole plate portion 18 in which the nozzle hole 10 is opened and the interference body plate portion 21 in which the interference body 20 is formed. In the interference body plate portion 21, the conical projection 23 having a round tip is formed at the center (the position corresponding to the central axis 22) of the bottom wall part 15 by counter-boring the bottom wall part 15 like a disc around the conical projection 23. In addition, the nozzle hole plate portion 18 has a shape formed by partially counter-boring the periphery of the nozzle hole 10 of the interference body plate portion 21 and the nozzle hole plate portion 18 is thinner than the interference body plate portion 21.

The four nozzle holes 10 are formed at regular intervals about the center (the central axis 22 of the nozzle plate 5) of the bottom wall part 15 so that part of each of the nozzle holes 10 passes through (is opened toward) the front and rear surfaces of the nozzle hole plate portion 18 and the fuel injection port 6 of the valve body 7 communicates with the outside. These nozzle holes 10 are formed so that nozzle hole centers 10*a* are positioned in the center line 24 or 25 (the straight line 24, passing through the central axis 22, that is parallel to the X-axis or the straight line 25, passing through the central axis 22, that is parallel to the Y-axis) of the bottom wall part 15. In addition, the nozzle holes 10 are straight round holes extending orthogonally to the inner plane 16 of the bottom wall part 15 and introduces, from the entrance side opening 26 facing the fuel injection port 6, the fuel injected through the fuel injection port 6 of the valve body 7 and injects the fuel introduced from the entrance side opening 26 from the exit side opening 27 (opening through which the fuel flows). The shape of the exit side opening 27 of the nozzle hole 10 is circular.

In addition, as illustrated in FIG. 12, the interference body plate portion 21 of the bottom wall part 15 is provided with the three interference bodies 20 partially blocking the nozzle hole 10 for each of the nozzle holes 10. The three interference bodies 20 form the orifice 11 line-symmetric with respect to the straight line 28 orthogonal to the center line 24 (25) passing though the nozzle hole center 10*a* and the center direction 30 of spray injected from the orifice 11 is obliquely inclined with respect to the center axis 10*c* of the nozzle hole 10 (obliquely inclined in the +Y direction FIGS. 12B and 12C) and the center direction 30 of the spray injected from the orifice 11 extends along the straight line 28. The center direction 30 of spray injected from each of the four orifices 11 is the counterclockwise direction about the central axis 22 of the bottom wall part 15. As a result, the spray injected from each of the four orifices 11 generates a counterclockwise swirl flow about the central axis 22.

In addition, as illustrated in detail in FIGS. 12B and 12C, the three interference bodies 20 are formed in the interference body plate portion 21 by partially cutting out a truncated cone and the orifice 11 is formed by partially blocking the nozzle hole 10. The corner portion 32 formed at an intersecting part between the arc-shaped outer edge part 31 of the interference body 20 and the circular exit side opening 27 of the nozzle hole 10 has an acute shape without roundness and makes the end of the liquid film of fuel passing though the orifice 11 acute and sharp so that the fuel is easily atomized by friction with air. Although the corner portion 32 is formed at the intersecting part between the arc-shaped outer edge part 31 of the interference body 20 and the circular exit side opening 27 of the nozzle hole 10 in the nozzle plate 5 according to the embodiment, the invention is not limited to the embodiment and the acute corner portion 32 without roundness may be formed by a linear outer edge part of the interference body 20 and the arc-shaped exit side opening 27 of the nozzle hole 10.

In addition, as illustrated in FIG. 12, the interference body 20 partially blocks the exit side opening 27 of the nozzle hole 10 and is provided with the fuel collision surface 34 positioned orthogonally to the central axis 10*c* of the nozzle hole 10 and the side surface (inclined plane) 35 intersecting the fuel collision surface 34 at an acute angle. The fuel collision surface 34 of the interference body 20 is formed so that the fuel collision surface 34 and the outer surface 36 (the surface opposite to the inner plane 16) of the nozzle hole plate portion 18 are present on a single plane. The side surface 35 of the interference body 20 is connected to the side surface (inclined plane) 38 connecting the outer surface 36 of the nozzle hole plate portion 18 to the outer surface 37 of the interference body plate portion 21. In addition, the side surface 38 connecting the outer surface 36 of the nozzle hole plate portion 18 to the outer surface 37 of the interference body plate portion 21 is formed away from the exit side opening 27 of the nozzle hole 10 so as to keep the same distance from the exit side opening 27 of the nozzle hole 10 opened toward the nozzle hole plate portion 18 to prevent interference with spray injected from the nozzle hole 10. In the embodiment, the side surface 38 connecting the outer surface 36 of the nozzle hole plate portion 18 to the outer surface 37 of the interference body plate portion 21 and the side surface 35 of the interference body 20 are formed at the same inclination angle so as to easily machine an injection molding die.

In addition, as illustrated in FIG. 11, on the outer plane 40 (the surface opposite to the inner plane 16) of the bottom wall part 15, the eight blades 13 with the same shape are formed at regular intervals about the central axis 22 integrally with the outer plane 40 so as to be positioned radially outward of the interference body plate portion 21. This blade 13 is arc-shaped in plan view and has a constant thickness from the radially inward end to the radially outward end. In addition, the blades 13 is cut obliquely upward from radially inward end so as not to obstruct spray injected from the orifice 11 and the fuel collision prevention part 41 is formed to obtain a space large enough to prevent the spray state of fuel injected from the orifice 11 from being affected. In addition, the blade 13 has the same blade height except the fuel collision prevention part 41 close to the radially inward end. The spacing between the pair of blades 13 and 13 adjacent to each other is reduced from radially outward to radially inward and the blade groove 42 between the blades 13 is narrowed from radially outward to radially inward.

As illustrated in FIG. 11A, in the blade 13, the radially outward end is displaced clockwise (right rotation direction) from the radially inward end. When an air flow from the radially outward end to the radially inward end is generated, this air flow interacts with an air flow generated by other adjacent blades 13 to generate a counterclockwise swirl flow about the central axis 22 of the bottom wall part 15.

In FIG. 11A, on the basis of the central axis 22 of the bottom wall part 15, the nozzle hole 10 having its center in the center line 24 extending in the +X-axis direction is assumed to be the first nozzle hole 10 and the nozzle holes 10 displaced counterclockwise by a multiple of 90 degrees from the first nozzle hole 10 are assumed to be the second to fourth nozzle holes 10. In addition, in FIG. 11A, when the central axis 22 of the bottom wall part 15 is the center of the X-Y coordinate plate of an orthogonal coordinate system, the blade groove 42 having its radially inward end in a position close to the +X-axis in the first quadrant is assumed to be the first blade groove 42 and the blade grooves 42 displaced counterclockwise by a multiple of 45 degrees from the first blade groove 42 are assumed to be the second to eighth blade grooves 42. In FIG. 11A described above, the center line 43 of the first blade groove 42 passes through the center of the second nozzle hole 10. The center line 43 of the third blade groove 42 passes through the center of the third nozzle hole 10. The center line 43 of the fifth blade groove 42 passes through the center of the fourth nozzle hole 10. The center line 43 of the seventh blade groove 42 passes through the center of the first nozzle hole 10. The center line 43 of the second blade groove 42 passes through the vicinity of the second nozzle hole 10. The center line 43 of the fourth blade groove 42 passes through the vicinity of the third nozzle hole 10. The center line 43 of the sixth blade groove 42 passes through the vicinity of the fourth nozzle hole 10. The center line 43 of the eighth blade groove 42 passes through the vicinity of the first nozzle hole 10. The center lines 43 of the first to eighth blade grooves 42 pass about (around the conical projection 23) of the central axis 22 of the bottom wall part 15.

Figure 13A:
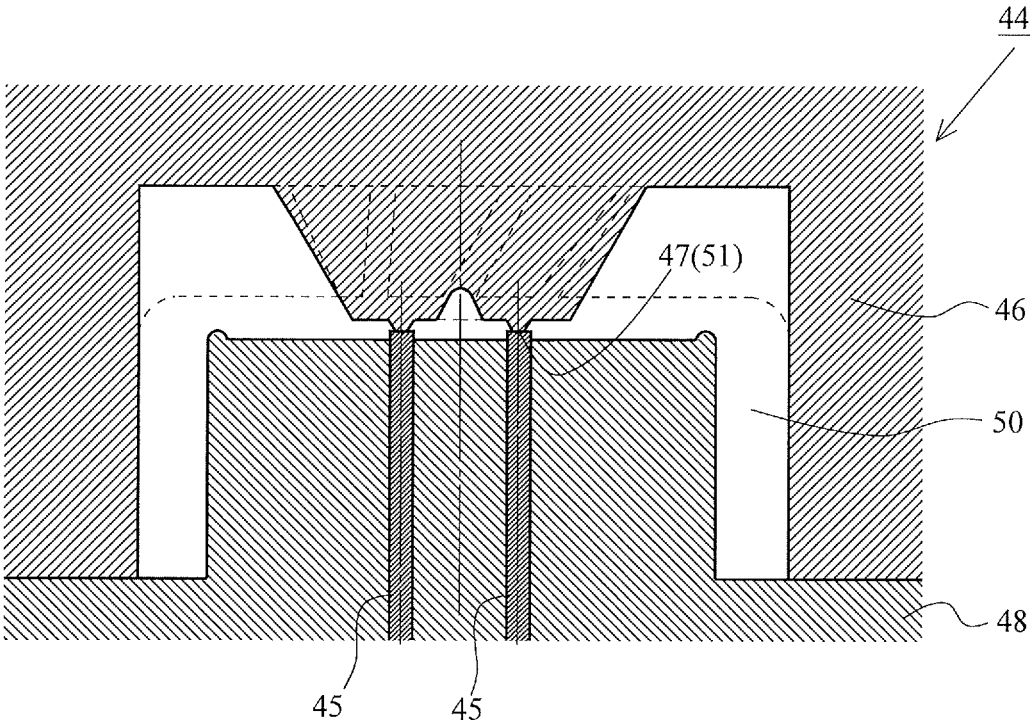
FIGS. 13A-13B are structural diagrams illustrating an injection molding die used for injection molding of the nozzle plate according to the second embodiment of the invention.
Figure 13B:
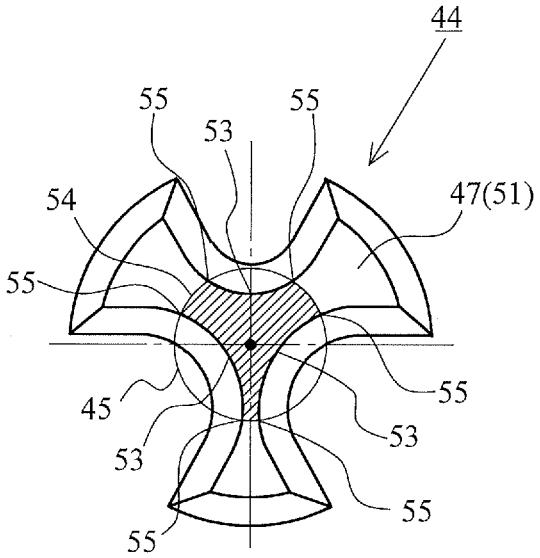

FIG. 13 is a structural diagram illustrating the injection molding die 44 used for injection molding of the nozzle plate 3. FIG. 13A is a vertical cross sectional view illustrating the injection molding die 44. In addition, FIG. 13B illustrates the cavity inner plane 47 in plan view of the first die 46 against which the nozzle hole formation pin 45 abuts.

As illustrated in FIG. 13, in the injection molding die 44, the cavity 50 is formed between the first die 46 and the second die 48 and the nozzle hole formation pins 45 for forming the nozzle holes 10 project into the cavity 50 (see particularly FIG. 13A). The tip of the nozzle hole formation pin 45 abuts against the cavity inner plane 47 of the first die 46 (see the shaded area in FIG. 13B). The part of the first die 46 against which the nozzle hole formation pin 45 abuts is the convex part 51 for forming the nozzle hole plate portion 18 and the orifice 11. The contour of the convex part 51 of the cavity inner plane 47 is easily machined by a machining tool having a blade part of the same inclination angle as in the side surface 35 of the interference body 20. In addition, the intersecting parts between front end side outer edges 53 of the convex part 51 of the cavity inner plane 47 and the front end side outer edge 54 of the nozzle hole formation pin 45 are acute and sharp corner portions 55 without roundness. The corner portions 55 formed at the intersecting parts between the front end side outer edges 53 of the convex parts 51 of the cavity inner plane 47 and the front end side outer edge 54 of the nozzle hole formation pin 45 shape the corner portions 32 in the intersecting parts between the arc-shaped outer edge parts 31 of the interference bodies 20 and the circular exit side opening 27 of the nozzle hole 10.

In the injection molding die 44 described above, when molten resin (molten material) is injected from a gate (not illustrated) into the cavity 50 and the molten resin in the cavity 50 is cooled and solidified, the nozzle plate 5 having the plurality of blades 13 integrated with the nozzle plate body 12 is formed (see FIG. 11). In addition, in the nozzle plate 5 injection molded by the injection molding die 44 described above, the fuel collision surface 34 of the interference body 20 and the outer surface 36 of the nozzle hole plate portion 18 are present on a single plane, the acute and sharp corner portions 32 without roundness are formed at the opening edge of the orifice 11. The nozzle plate 5 injection molded as described above has higher production efficiency than nozzle plates formed by etching or discharge machining, thereby achieving reduction in the product unit price.

In the nozzle plate 5 configured as described above, since the pressures of the exit side peripheral portions of the orifices 11 are reduced (lower than the atmospheric pressure) when fuel is injected from the orifices 11, the air around the nozzle plate 5 flows (is drawn) from the radially outward end to the radially inward end of the first to eighth blade grooves 42 and the air flows from the radially inward end of the first to eighth blade grooves 42 to the nozzle hole center 10*a* of the nozzle hole 10 or the vicinity of the nozzle hole 10. That is, the air from the radially inward end of the first to eighth blade grooves 42 flows about the central axis 22 of the bottom wall part 15 with a predetermined distance (at least the distance corresponding to the shape of the conical projection 23) away from the central axis 22, thereby causing a counterclockwise swirl flow about the central axis 22 of the bottom wall part 15. In addition, atomized droplets (fine particles of fuel) in the spray have kinetic momentum (counterclockwise speed component), draw peripheral air and air swirling around the periphery, and provide the drawn air with kinetic momentum. The air having kinetic momentum flows helically and transports the droplets (fine particles of fuel). The droplets (fine particles of fuel) in the spray are prevented from scattering peripherally because they are transported by the helical air flow. Accordingly, the nozzle plate 5 according to the embodiment can reduce the amount of fuel attached to the wall surface of the intake air pipe 2 and the like, thereby improving the utilization efficiency of fuel (see FIG. 1).

In addition, in the nozzle plate 5 according to the embodiment, since the eight blades 13 are formed at regular intervals about the central axis 22 integrally with the bottom wall part 15 so as to be positioned radially outward of the interference body plate portion 21, the blades 13 can prevent a tool or the like from colliding with the nozzle hole 10 and its periphery when the nozzle plate 5 is assembled to the valve body 7 and the blades 13 can prevent the nozzle hole 10 of the bottom wall part 15 and its peripheral portions from being damaged. In addition, in the nozzle plate 5 according to the embodiment, when the fuel injection device 1 having the nozzle plate 5 assembled to the valve body 7 is assembled to the intake air pipe 2 of the engine, the blades 13 can prevent engine components and the like from colliding with the nozzle hole 10 and its periphery and the blades 13 can prevent the nozzle hole 10 of the bottom wall part 15 and its peripheral portions from being damaged.

In the nozzle plate 5 according to the embodiment, part of fuel injected from the fuel injection port 6 of the fuel injection device 1 collides with the fuel collision surface 34 of the interference body 20 and is atomized, the flow of the fuel is steeply bent by the fuel collision surface 34, the bent flow collides with the fuel attempting to pass straight through the nozzle hole 10 and the orifice 11, and the flow of the fuel attempting to pass straight through the nozzle hole 10 and the orifice 11 is disturbed. In addition, the nozzle plate 5 according to the embodiment has the acute and sharp corner portions 32 without roundness at the opening edge of the orifice 11 and the opening edge of the orifice 11 is narrowed toward the corner portions 32. As a result, in the nozzle plate 5 according to the embodiment, of the fuel injected from the orifice 11, the liquid film of the fuel injected from the corner portions 32 of the orifice 11 and the vicinity of the corner portions 32 becomes thin and acutely sharp, thereby facilitating the atomization of the fuel injected from the corner portion 32 of the orifice 11 and the vicinity of the corner portion 32 by friction with air in the vicinity of the orifice 11. In the nozzle plate 1002 according to the first conventional example, since the entrance side nozzle hole part 1003*a* positioned close to the fuel injection port 1001 of the fuel injection device 1000 and the exit side nozzle hole part 1003*b* positioned on the downstream side in the fuel injection direction of the entrance side nozzle hole part 1003*a* are machined by etching, corner parts 1007 of the exit side nozzle hole part 1003*b* are rounded. As a result, in the nozzle plate 1002 according to the first conventional example, the fuel injected from the nozzle hole 1003 does not easily become an acute liquid film, thereby making the atomization of the fuel by friction with air insufficient. As compared with the nozzle plate 1002 according to the first conventional example as described above, the nozzle plate 5 according to the embodiment further improves the degree of atomization of the fuel injected from the orifice 11.

In the nozzle plate 5 according to the embodiment, since the side surface 35 of the interference body 20 is formed to intersect the fuel collision surface 34 of the interference body 20 at an acute angle and an air layer is generated between the fuel passing through the orifice 11 and the side surface 35 of the interference body 20, the fuel passing through the orifice 11 is likely to draw air, thereby promoting the atomization of the fuel passing though the orifice 11.

(Modification 1 of Second Embodiment)

Figure 14A:
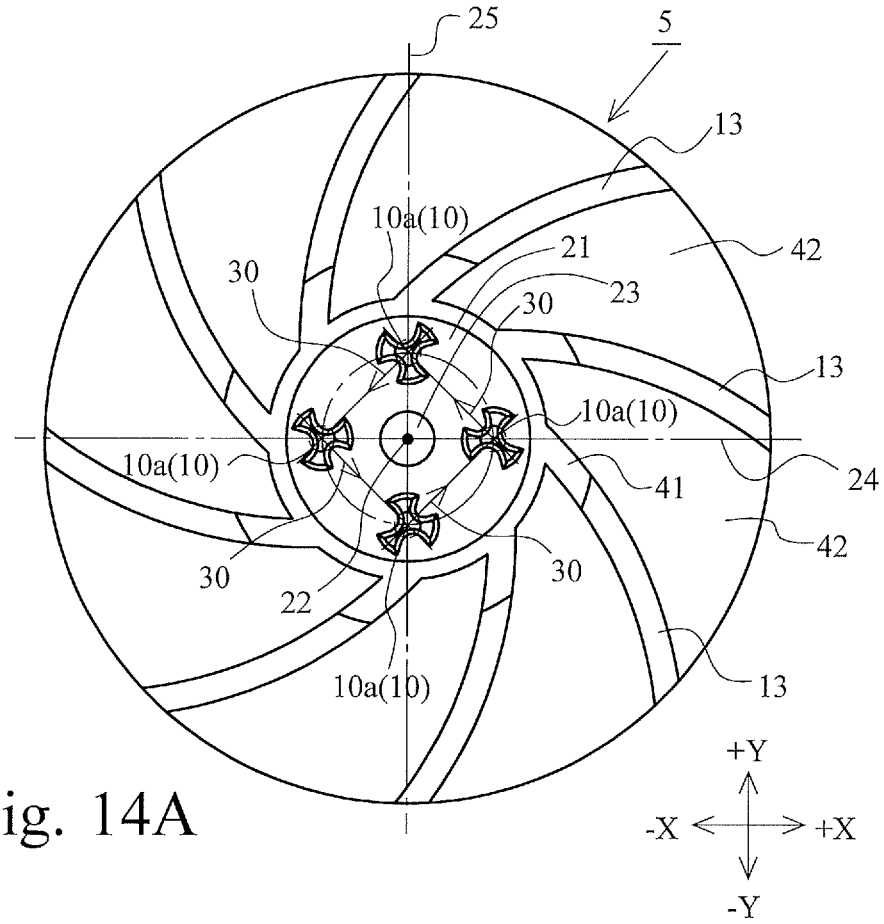
FIGS. 14A-14B illustrate a nozzle plate according to modification 1 of the second embodiment of the invention.
Figure 14B:
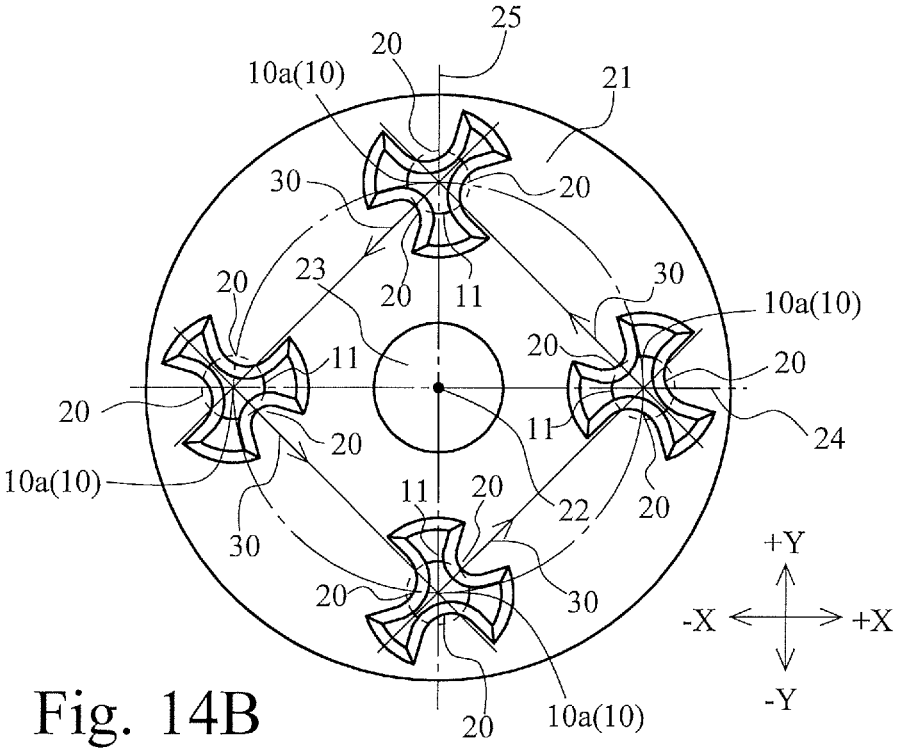

FIG. 14 illustrates the nozzle plate 5 according to modification 1 of the second embodiment of the invention. FIG. 14A is a front view illustrating the nozzle plate 5 and this drawing corresponds to FIG. 11A. In addition, FIG. 14B is an enlarged view illustrating the central part of the nozzle plate 5 and this drawing corresponds to FIG. 12A.

In the nozzle plate 5 according to the modification, the three interference bodies 20 are formed for each nozzle hole 10 so that the center direction 30 of spray injected from each of the orifices 11 is oriented to the nozzle hole center 10*a* of another adjacent nozzle hole 10 (positioned on the front side along the fuel injection direction). That is, the nozzle plate 5 according to the modification is formed by rotating the orifices 11 (see FIG. 11A) of the nozzle plate 5 according to the second embodiment counterclockwise about the nozzle hole centers 10*a* of the nozzle holes 10 by 45 degrees and displacing the four nozzle holes 10 and the four orifices 11 (see FIG. 11A) radially outward of the central axis 22 of the bottom wall part 15.

In the nozzle plate 5 according to the embodiment formed as described above, as compared with the nozzle plate 5 according to the second embodiment, effects of spray from the adjacent orifices 11 are large, the air swirled by the plurality of blades 13 receives more kinetic momentum in the swirl direction from fine particles of the fuel in spray and a stronger helical air flow is formed.

(Modification 2 of Second Embodiment)

Figure 15C:
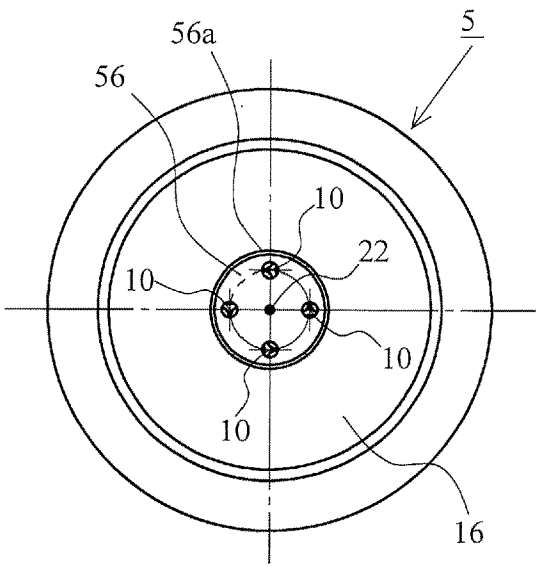
FIGS. 15A-15C illustrate a nozzle plate according to modification 2 of the second embodiment of the invention.
Figure 15B:
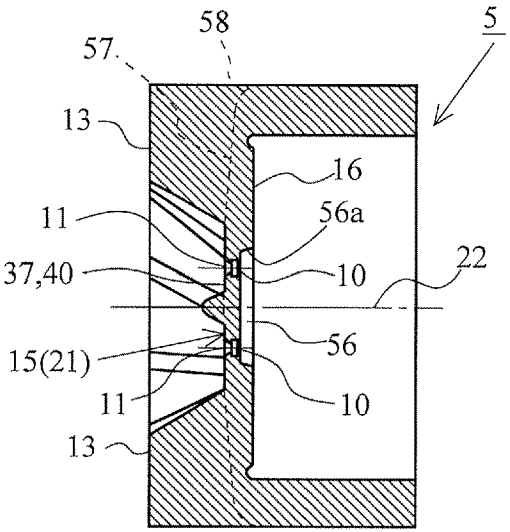
Figure 15A:
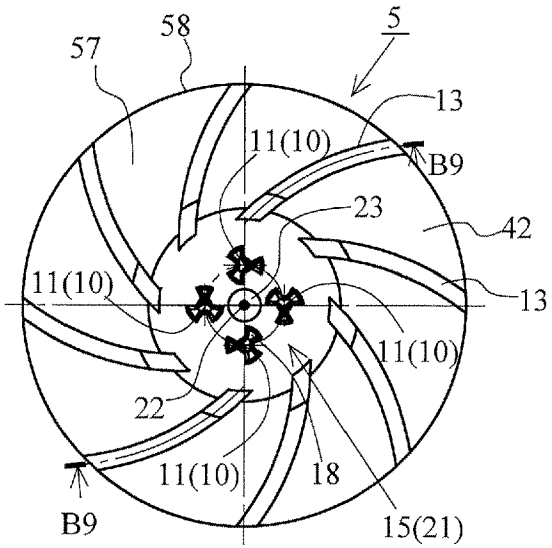

FIG. 15 illustrates the nozzle plate 5 according to modification 2 of the second embodiment of the invention. FIG. 15A is a front view illustrating the nozzle plate 5 and this drawing corresponds to FIG. 11A. In addition, FIG. 15B is a cross sectional view taken along the line B9-B9 in FIG. 15A. In addition, FIG. 15C is a back view illustrating the nozzle plate 5 and this drawing corresponds to FIG. 11D.

In the nozzle plate 5 according to the modification, the outer surface 37 of the interference body plate portion 21 and the outer plane 40 of the bottom wall part 15 are present on a single plane and there is a difference from the nozzle plate 5 according to the second embodiment in which the interference body plate portion 21 is formed by counter-boring the bottom wall part 15 like a disc. In addition, in the nozzle plate 5 according to the modification, a bottomed round hole 56 is formed on the back of the bottom wall part 15 by counter-boring the back to make the thickness of the nozzle hole plate portion 18 and the thickness of the interference body plate portion 21 identical to those in the nozzle plate 5 according to the second embodiment. The four nozzle holes 10 are opened in the bottom of the round hole 56. The side surface 56*a* of the round hole 56 is positioned so as to surround the four nozzle holes 10.

In addition, in the nozzle plate 5 according to the modification, the bottom wall part 15 is obliquely cut from the position slightly radially outward of the radially inward end of the blade 13 toward the radially outward end to form the hollow-disc-shaped inclined plane 57. The radially outward end of the hollow-disc-shaped inclined plane 57 is rounded as the smoothly curved surface 58. As a result, the nozzle plate 5 according to the modification can widely and smoothly introduce air around the blade groove 42 in the blade groove 42 as compared with the nozzle plate 5 according to the second embodiment. In addition, since the outer surface 37 of the interference body plate portion 21 and the outer plane 40 of the bottom wall part 15 are present on a single plane as described above in the nozzle plate 5 according to the modification, as compared with the nozzle plate 5 according to the second embodiment in which the interference body plate portion 21 is formed by counterboring the bottom wall part 15 like a disc, the air flowing from the radially inward end of the blade groove 42 to the interference body plate portion 2 is not easily affected by the recessed portion, thereby increasing the speed of the air flowing from the radially inward end of the blade groove 42 to the orifice 11.

In the nozzle plate 5 according to the modification configured as described above, since the speed of the air flowing from the radially inward end of the blade groove 42 to the orifice 11 is larger than in the nozzle plate 5 according to the second embodiment, if the air flowing to the orifice 11 receives kinetic momentum from fine particles in the sprayed fuel, a stronger helical air flow is formed.

(Modification 3 of Second Embodiment)

Figure 16A:
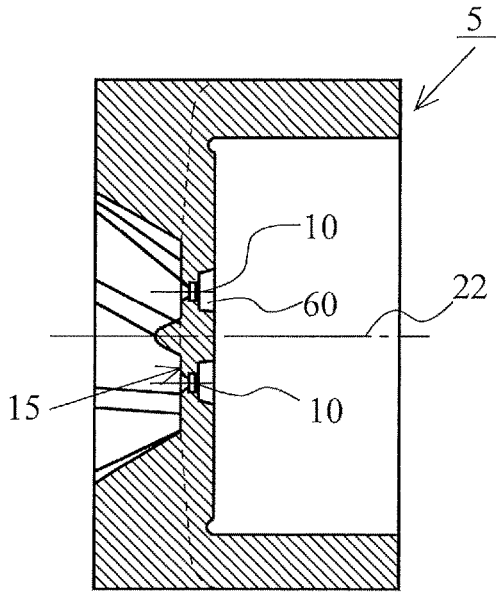
FIGS. 16A-16B illustrate a nozzle plate according to modification 3 of the second embodiment of the invention and illustrates a modification of the nozzle plate according to modification 2 of the second embodiment.
Figure 16B:
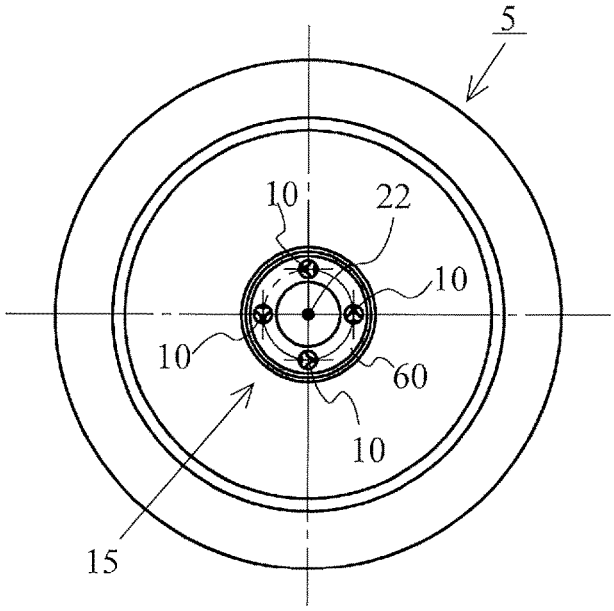

FIG. 16 illustrates the nozzle plate 5 according to modification 3 of the second embodiment of the invention and illustrates a modification of the nozzle plate 5 according to modification 2 of the second embodiment. FIG. 16A is a cross sectional view illustrating the nozzle plate 5 and this drawing corresponds to FIG. 15B and FIG. 16B is a back view illustrating the nozzle plate 5 and this drawing corresponds to FIG. 15C.

In the nozzle plate 5 according to the modification illustrated in FIG. 16, the round hole 56 formed on the back surface of the bottom wall part 15 of the nozzle plate 5 according to modification 2 of the second embodiment is replaced with the ring-shaped hole 60 so that the amount of fuel stored in the hole 60 is less than the amount of fuel stored in the round hole 56.

(Modification 4 of Second Embodiment)

Figure 17A:
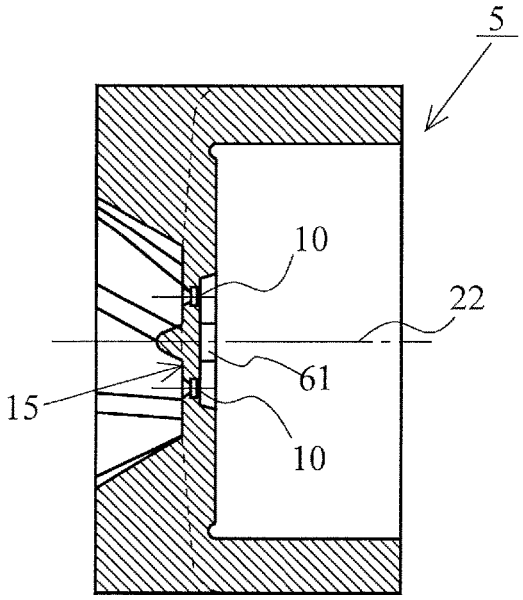
FIGS. 17A-17B illustrate a nozzle plate according to modification 4 of the second embodiment of the invention and illustrates a modification of the nozzle plate according to modification 2 of the second embodiment.
Figure 17B:
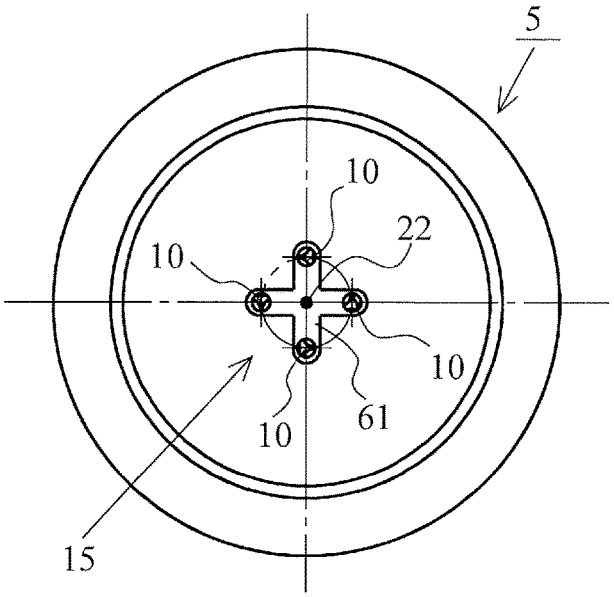

FIG. 17 illustrates the nozzle plate 5 according to modification 4 of the second embodiment of the invention and illustrates a modification of the nozzle plate 5 according to modification 2 of the second embodiment. FIG. 17A is a cross sectional view illustrating the nozzle plate 5 and this drawing corresponds to FIG. 15B and FIG. 17B is a back view illustrating the nozzle plate 5 and this drawing corresponds to FIG. 15C.

In the nozzle plate 5 according to the modification illustrated in FIG. 17, the round hole 56 formed on the back surface of the bottom wall part 15 of the nozzle plate 5 according to modification 2 of the second embodiment is replaced with the crisscross hole 61 so that the amount of fuel stored in the hole 61 is less than the amount of fuel stored in the round hole 104.

(Other Modifications of Second Embodiment)

Figure 18B:
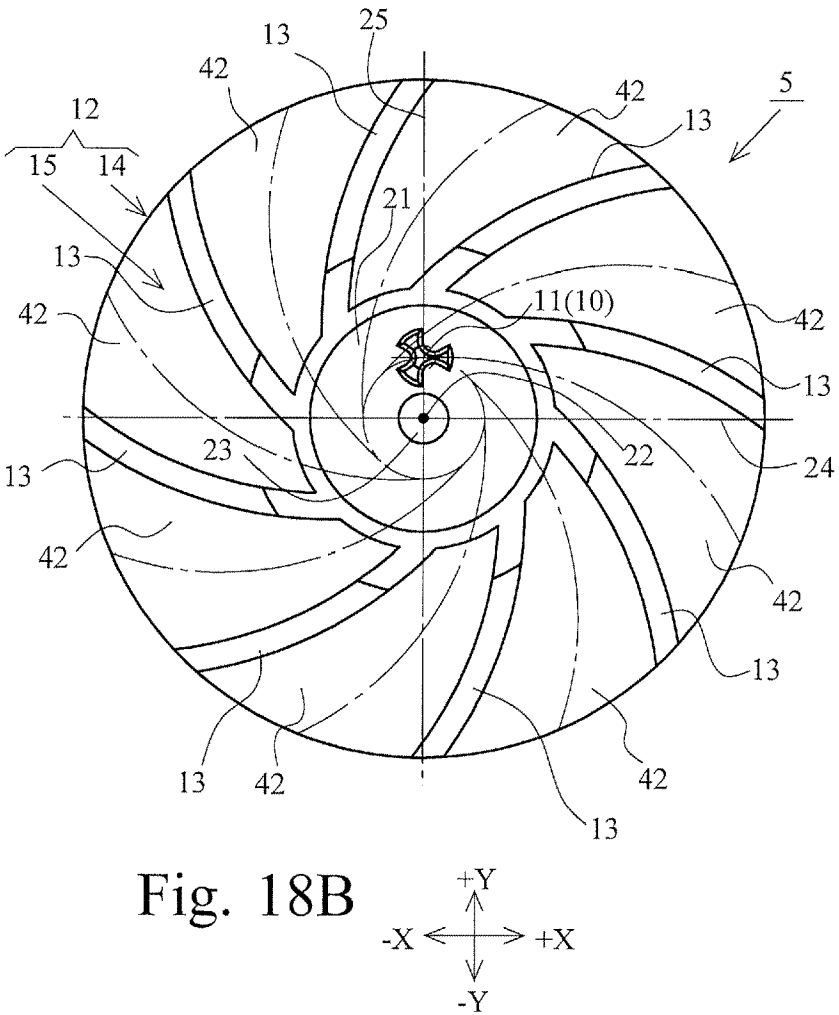
FIGS. 18A-18B illustrate nozzle plates according to other modifications of the second embodiment of the invention.
Figure 18A:
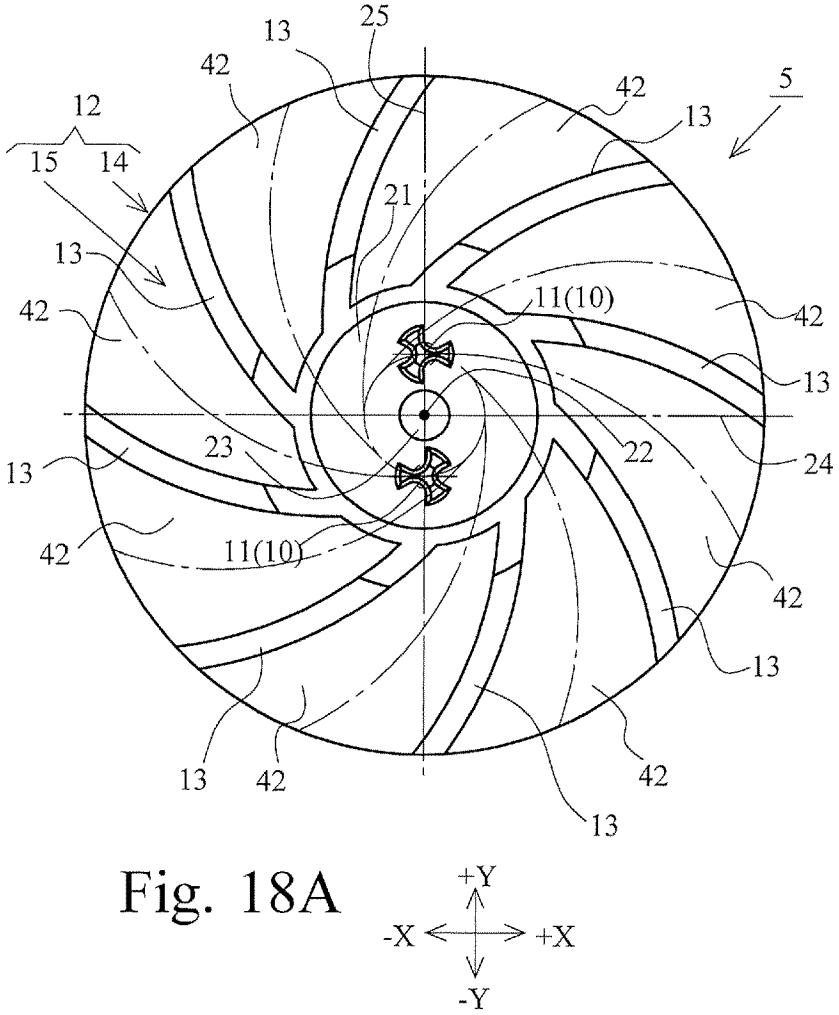

In the nozzle plate 5 according to the second embodiment of the invention, the four nozzle hole 10 and the four orifices 11 are formed at regular intervals about the central axis 22 of the bottom wall part 15. However, the invention is not limited to the embodiment and the two nozzle holes 10 and the two orifices 11 may be formed at regular intervals about the central axis 22 of the bottom wall part 15 as illustrated in FIG. 18A. In addition, as illustrated in FIG. 18B, one nozzle hole 10 and one orifice 11 may be formed in the bottom wall part 15. In FIGS. 18A and 18B, the center direction 30 of fuel injected from the orifice 11 is oriented counterclockwise and the flow of air flowing in via the blade groove 42 generates a counterclockwise swirl flow.

In addition, in the nozzle plates 5 according to the second embodiment and the modifications of the second embodiment, the four nozzle holes 10 are formed and twice as many (eight) blades 13 as the nozzle holes 10 are provided. However, the invention is not limited to the embodiment and the modifications and the plurality of (two or more) nozzle holes 10 may be formed and twice as many blades 13 as nozzle holes 10 may be provided. In addition, in the nozzle plates 5 according to the second embodiment and the modifications of the second embodiment, twice as many blade grooves 42 as the nozzle holes 10 are provided. However, the invention is not limited to the embodiment and the modifications and as many blade grooves 42 as the nozzle holes 10 may be provided. In addition, in the nozzle plates 5 according to the second embodiment and the modifications of the second embodiment, twice as many blade grooves 42 as the nozzle holes 10 are formed. However, the invention is not limited to the embodiment and the modifications and a number of the blade grooves 42 equal to a multiple of the number of the nozzle holes 10 may be provided.

In addition, in the nozzle plates 5 according to the second embodiment and the modifications of the second embodiment, the shapes (right hand helix shapes) of the orifice 11 and the blade 13 are determined so as to generate a counterclockwise swirl flow about the central axis 22 of the bottom wall part 15. However, the invention is not limited to the nozzle plate 5 of the second embodiment and the modifications of the second embodiment and the shapes (left hand helix shapes) of the orifice 11 and the blade 13 may be determined so as to generate a clockwise swirl flow about the central axis 22 of the bottom wall part 15.

In addition, in the nozzle plates 5 according to the second embodiment and the modifications of the second embodiment, the blade 13 is arc-shaped in plan view (see FIG. 11A). However, the invention is not limited to the second embodiment and the modifications of the second embodiment and the blade 13 may be linear in plan view.

In addition, in the nozzle plates 5 according to the second embodiment and the modifications of the second embodiment, when a swirl flow can be generated by the plurality of blades 13, the conical projection 23 may be omitted as appropriate.

Third Embodiment

Figure 19A:
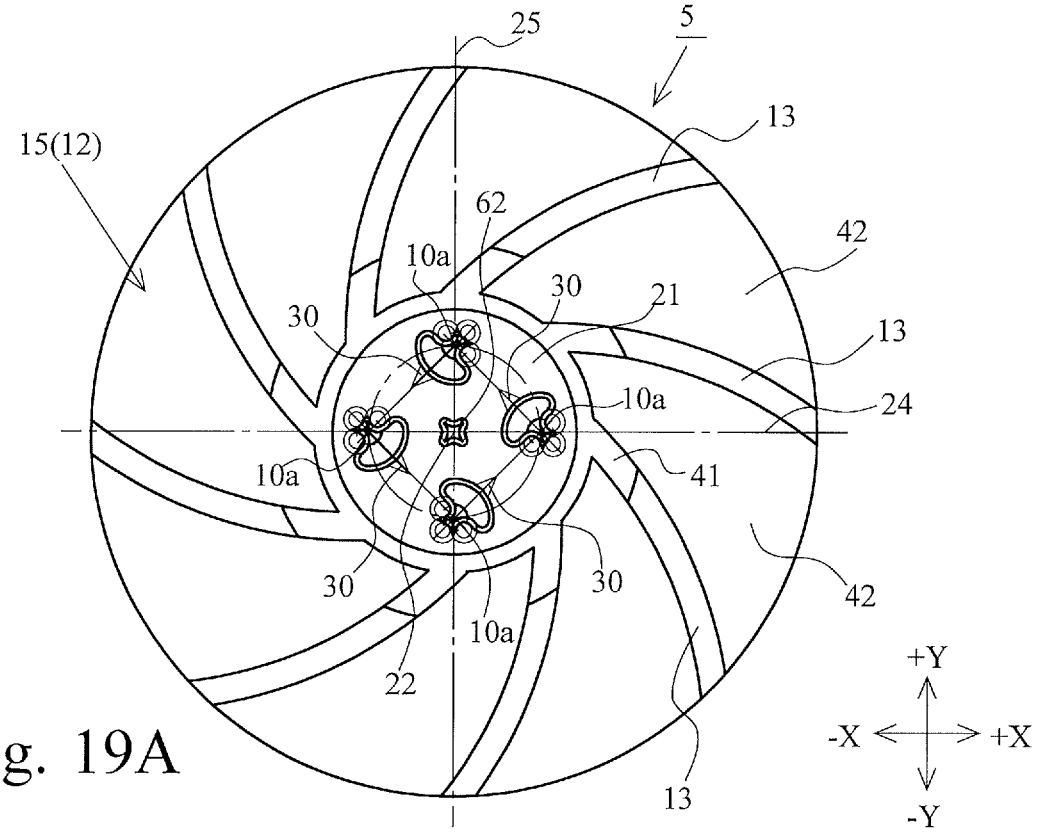
FIGS. 19A-19B illustrate a nozzle plate according to a third embodiment of the invention and illustrates a structure obtained by further modifying the nozzle plate according to modification 1 of the first embodiment.
Figure 19B:
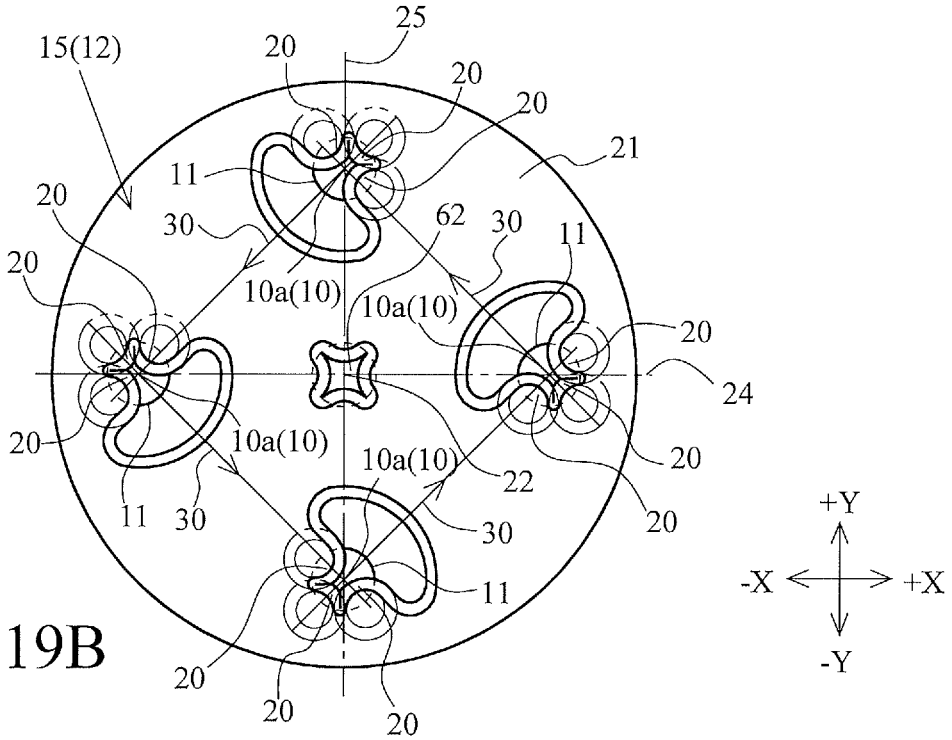
Figure 20A:
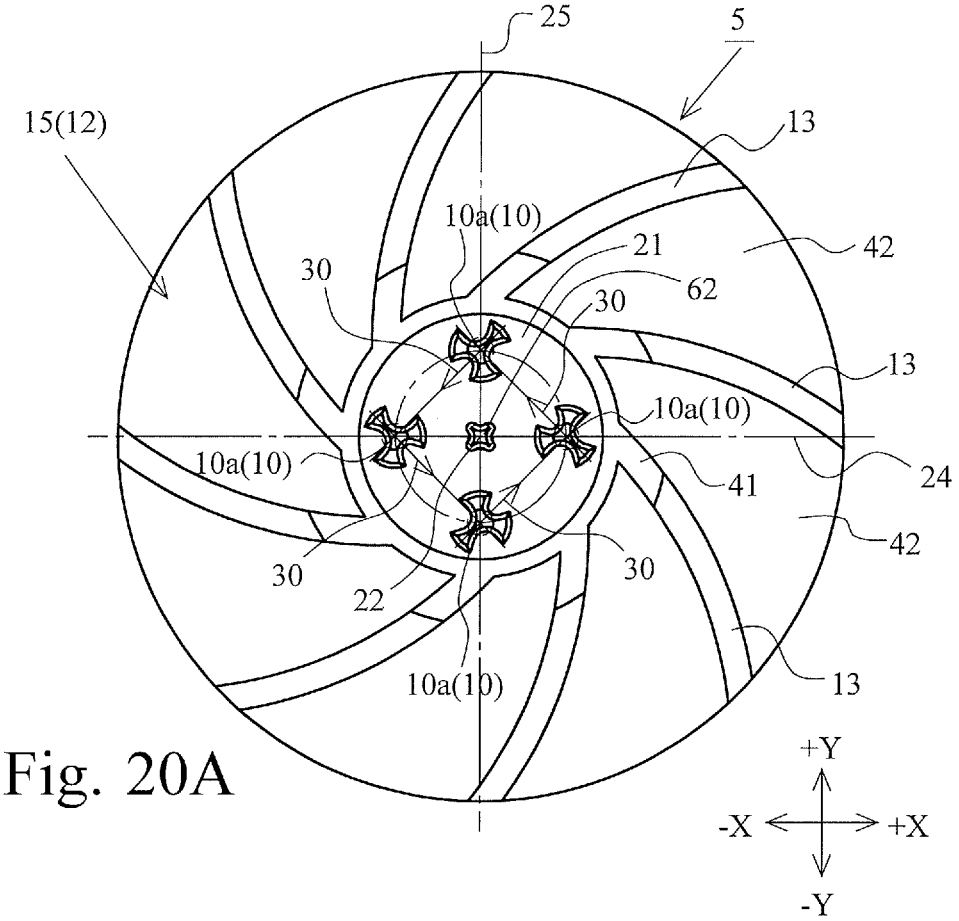
FIGS. 20A-20B illustrate a nozzle plate according to the third embodiment of the invention and illustrates a structure obtained by further modifying the nozzle plate according to modification 1 of the second embodiment.
Figure 20B:
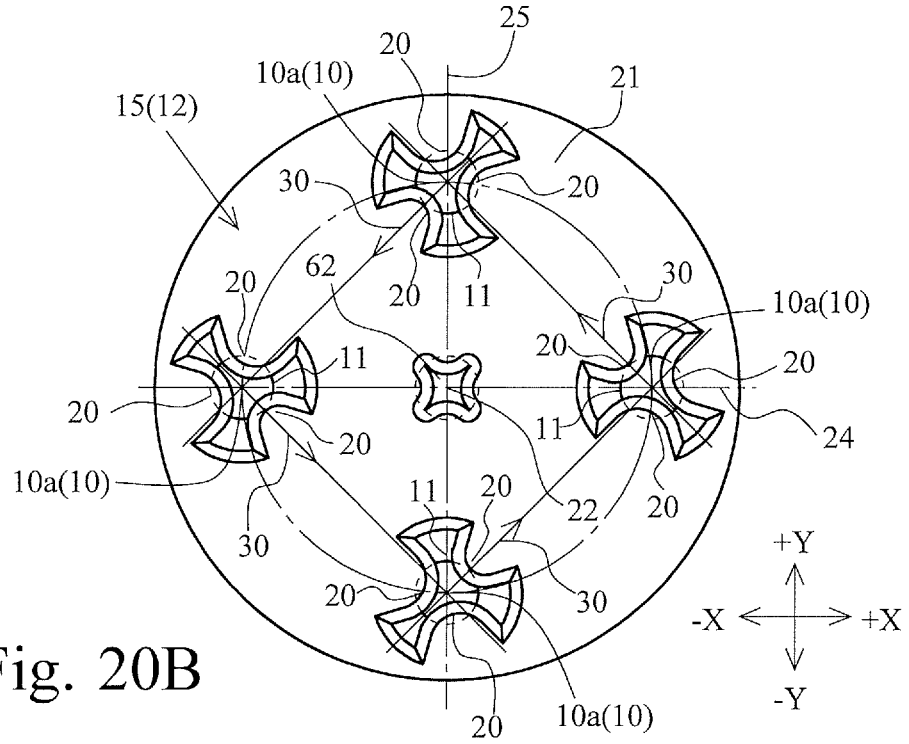
Figure 21A:
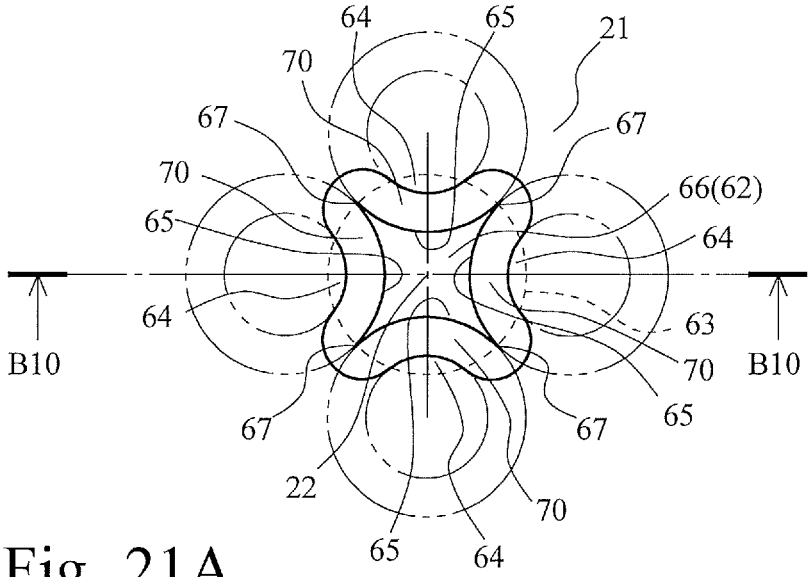
FIGS. 21A-21B are enlarged views illustrating the central parts of the nozzle plates in FIGS. 19 and 20.
Figure 21B:
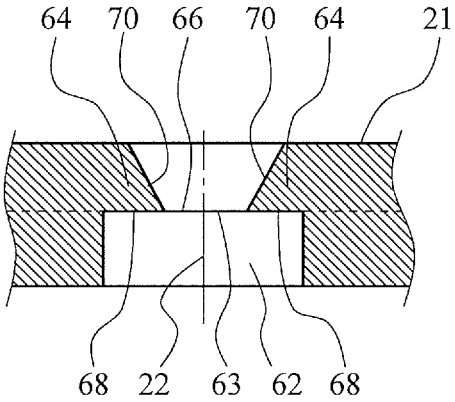

FIGS. 19 to 21 illustrate the nozzle plate 5 according to the third embodiment of the invention. FIG. 19 illustrates a structure obtained by modifying the nozzle plate 5 according to modification 1 of the first embodiment. In addition, FIG. 20 illustrates a structure obtained by further modifying the nozzle plate 5 according to modification 1 of the second embodiment. In addition, FIG. 21 is an enlarged view illustrating the central part of the nozzle plates 5 illustrated in FIGS. 19 and 20.

As illustrated in these drawings, at the central point (the position corresponding to the central axis 22) of the bottom wall part 15, the nozzle plate 5 has a central nozzle hole 62 passing through the bottom wall part 15 along the central axis 22. In the central nozzle hole 62, an exit side opening 63 close to the outer plane is partially blocked by four interference bodies 64. The four interference bodies 64 form a center orifice 66 by causing arc-shaped outer edge parts 65 to overhang radially inward of the central nozzle hole 62 and partially block the exit side opening 63 of the central nozzle hole 62. In addition, the arc-shaped outer edge parts 65 and 65 of the interference bodies 64 and 64 adjacent to each other make contact with each other at the opening edge of the exit side opening 63 of the central nozzle hole 62. A corner portion 67 is formed at the intersection of the pair of arc-shaped outer edge parts 65 and 65. The four corner portions 67 are formed at regular intervals at the opening edge of the center orifice 66 and have an acute and sharp shape without roundness. As a result, the corner portions 67 have an acute and sharp shape without roundness so that the end part of the liquid film of fuel passing though the center orifice 66 can be easily atomized by friction with air. In addition, the interference body 64 has a fuel collision surface 68 orthogonal to the central axis 22 of the central nozzle hole 62 and the side surface (inclined plane) 70 cut obliquely upward from the arc-shaped outer edge part 65. In addition, the side surfaces 70 of the interference bodies 64 and 64 adjacent to each other are smoothly connected like an arc at the corner portion 67.

In the nozzle plate 5 according to the embodiment described above, the spray generated by injecting fuel from the center orifice 66 at the central point of the bottom wall part 15 is added to the spray generated by injecting fuel from the four orifices 11 of the bottom wall part 15, the peripheral spray is drawn by the center spray, the air swirled by the plurality of blades 13 of the orifice 66 is given more kinetic momentum in the swirling direction by the fine particles of the fuel in spray, and a stronger helical air flow is formed.

In addition, the nozzle plate 5 according to the embodiment is applicable to the nozzle plates 5 according to the first and second embodiments and the same effects as in the nozzle plates 5 according to the first and second embodiments can be obtained.

Fourth Embodiment

Figure 22C:
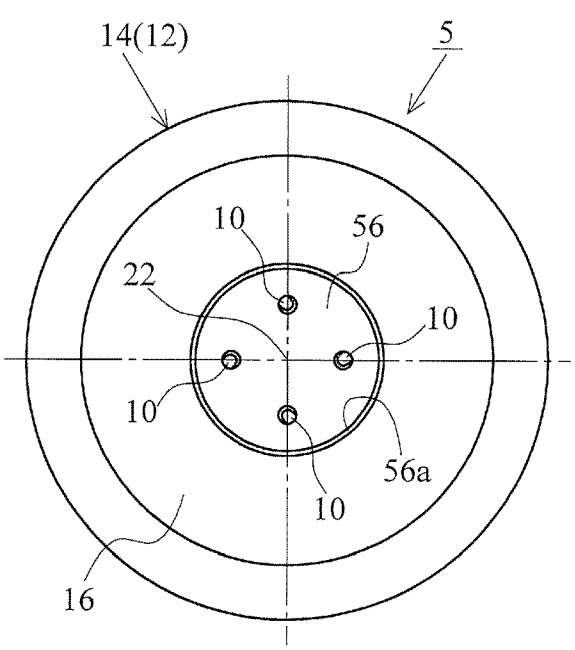
FIGS. 22A-22C illustrate a nozzle plate according to a fourth embodiment of the invention.
Figure 22B:
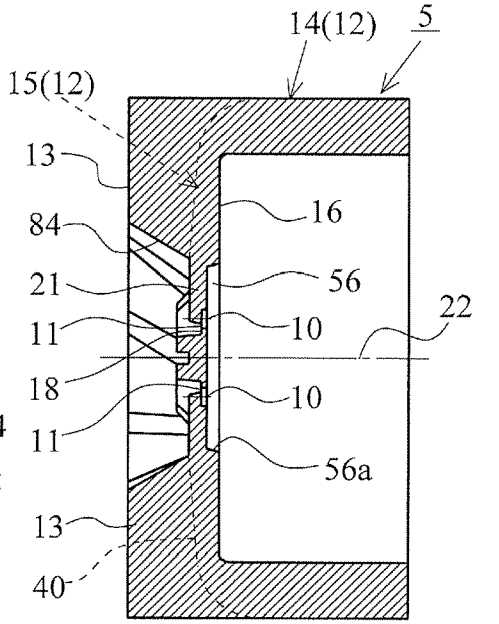
Figure 22A:
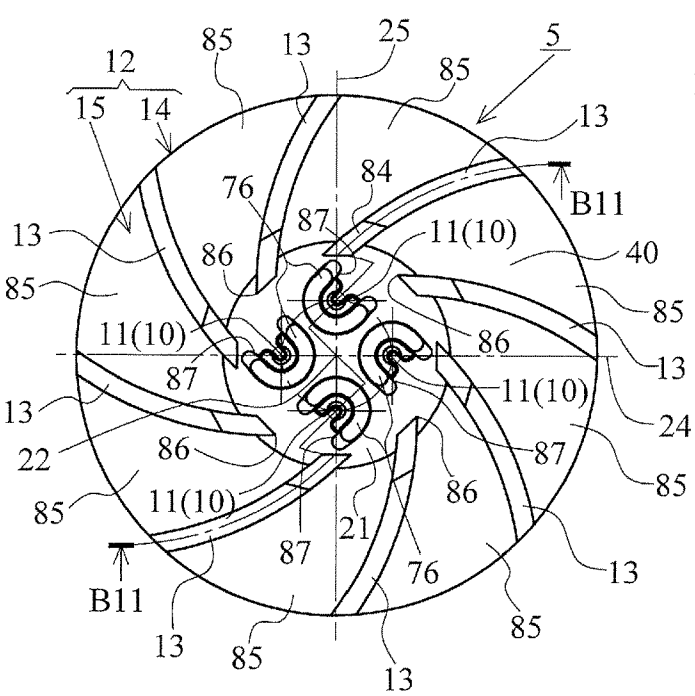
Figure 23A:
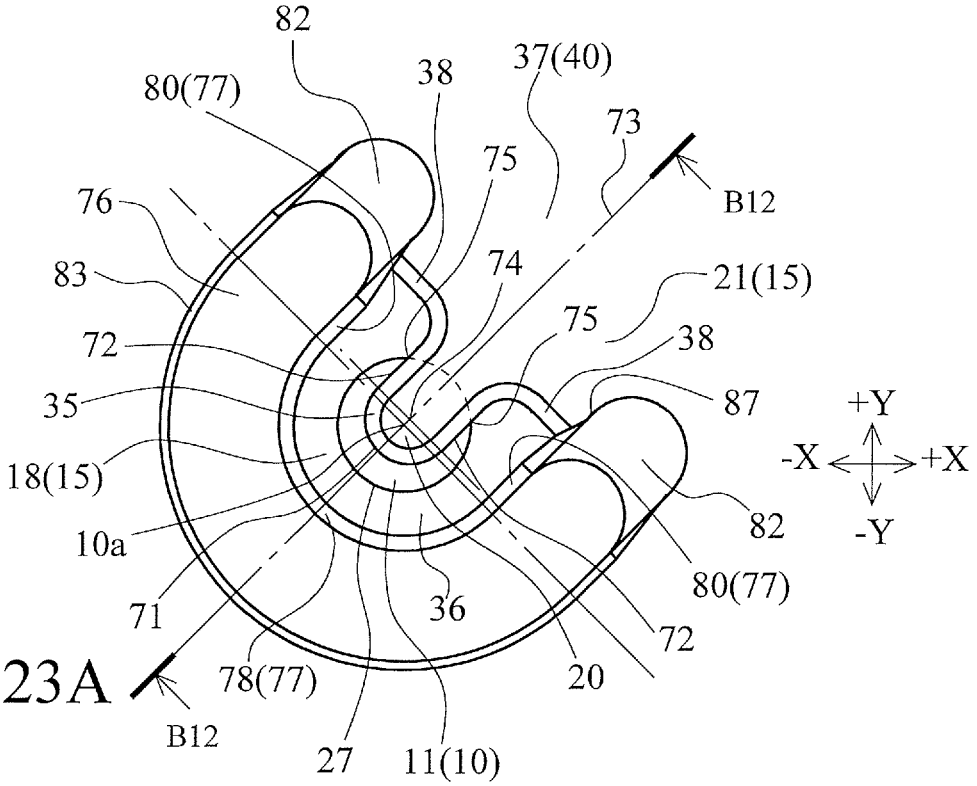
FIG. 23A is an enlarged view illustrating the nozzle hole in FIG. 22A and the vicinity of the nozzle hole.
Figure 23B:
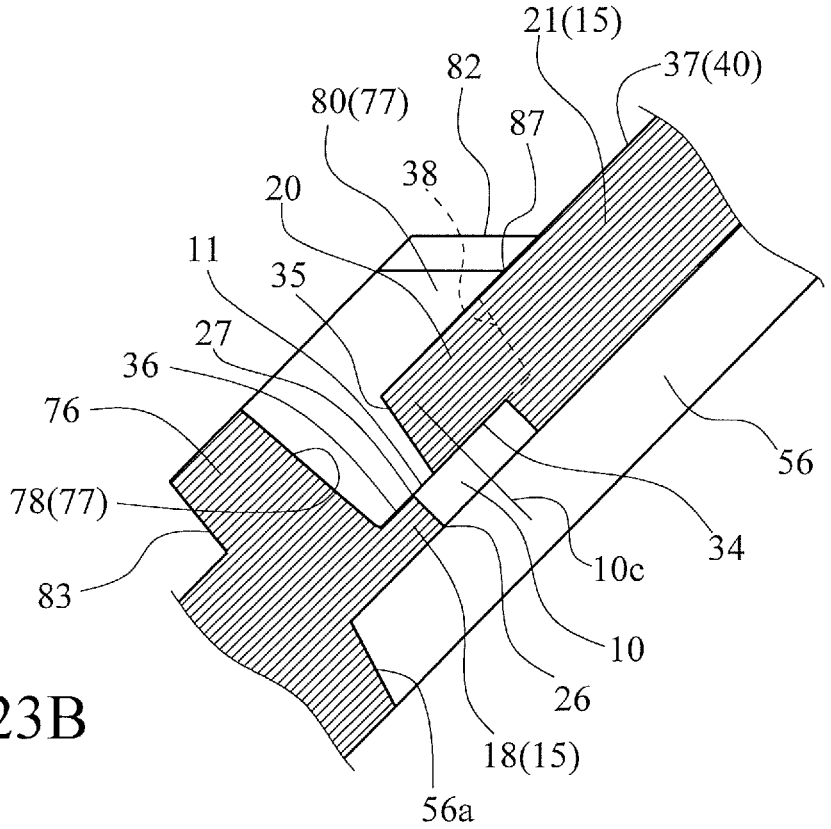
FIG. 23B is a partial cross sectional view illustrating the nozzle plate taken along a line B12-B12 in FIG. 23A.

FIGS. 22 and 23 illustrate the nozzle plate 5 according to the fourth embodiment of the invention. FIG. 22A is a front view illustrating the nozzle plate 5, FIG. 22B is a cross sectional view illustrating the nozzle plate 5 taken along a line B11-B11 in FIG. 22A, and FIG. 22C is a back view illustrating the nozzle plate 5. In addition, FIG. 23A is an enlarged view illustrating the nozzle hole 10 in FIG. 22A and the periphery of the nozzle hole 10 and FIG. 23B is a partial cross sectional view illustrating the nozzle plate 5 taken along the line B12-B12 in FIG. 23A.

In the nozzle plate 5 according to the embodiment illustrated in FIGS. 22 and 23, the plurality of blades 13 are injection molded integrally with the nozzle plate body 12, as in the nozzle plate 5 according to the first embodiment. In addition, the nozzle plate body 12 according to the embodiment is a bottomed cylindrical body, made of synthetic resin material (for example, PPS, PEEK, POM, PA, PES, PEI, LCP), that includes the cylindrical wall part 14 and the bottom wall part 15 on one end side of the cylindrical wall part 14 as in the nozzle plate body 12 according to the first embodiment. In addition, the nozzle plate 5 is fixed to the valve body 7 in the state in which the nozzle plate body 12 and the cylindrical wall part 14 are fitted onto the front end side outer periphery of the valve body 7 without any space and the inner plane 16 of the bottom wall part 15 is fixed to the valve body 7 in a state of abutting against the front end surface 17 of the valve body 7 (see FIG. 2).

The bottom wall part 15 includes the nozzle hole plate portion 18 in which the nozzle hole 10 is opened and the interference body plate portion 21 in which the interference body 20 is formed. The outer surface of the interference body plate portion 21 and the outer plane 40 of the bottom wall part 15 are present on a single plane. In the nozzle plate 5 according to the embodiment, the bottomed round hole 56 is formed on the back of the bottom wall part 15 by counter-boring the back to make the thickness of the nozzle hole plate portion 18 and the thickness of the interference body plate portion 21 identical to those in the nozzle plate 5 according to the first embodiment. The four nozzle holes 10 are opened in the bottom of the round hole 56. The side surface 56*a* of the round hole 56 is positioned so as to surround the four nozzle holes 10. In addition, the nozzle hole plate portion 18 has a shape formed by partially counter-boring the periphery of the nozzle hole 10 of the interference body plate portion 21 and the nozzle hole plate portion 18 is thinner than the interference body plate portion 21.

The four nozzle holes 10 are formed at regular intervals about the center (the central axis 22 of the nozzle plate 5) of the bottom wall part 15 so that part of each of the nozzle holes 10 passes through (is opened toward) the front and rear surfaces of the nozzle hole plate portion 18 and the fuel injection port 6 of the valve body 7 communicates with the outside. These nozzle holes 10 are formed so that nozzle hole centers 10*a* are positioned in the center line 24 or 25 (the straight line 24, passing through the central axis 22, that is parallel to the X-axis or the straight line 25, passing through the central axis 22, that is parallel to the Y-axis) of the bottom wall part 15. In addition, the nozzle holes 10 are straight round holes extending orthogonally to the inner plane 16 of the bottom wall part 15 and introduces, from the entrance side opening 26 facing the fuel injection port 6, the fuel injected through the fuel injection port 6 of the valve body 7 and injects the fuel introduced from the entrance side opening 26 from the exit side opening 27 (opening through which the fuel flows). The shape of the exit side opening 27 of the nozzle hole 10 is circular.

In addition, as illustrated in FIG. 23, in the interference body plate portion 21 of the bottom wall part 15, one interference body 20 for blocking part of the nozzle hole 10 is formed for each of the nozzle holes 10. This interference body overhangs at the exit side opening 27 of the nozzle hole 10 like a cantilever and has a semicircular outer edge part 71 at the tip and a pair of linear outer edge parts 72 and 72, parallel to each other, that are connected to the ends of the semicircular outer edge part 71. In addition, the interference body 20, the semicircular outer edge part 71, the pair of linear outer edge parts 72 and 72, and the circular exit side opening 27 of the nozzle hole 10 form the opening edge of the orifice 11 and form the orifice 11 line-symmetric with respect to the center line 73 passing through the nozzle hole center 10*a*. A curvature center 74 of the semicircular outer edge part 71 of the interference body 20 is displaced from the nozzle hole center 10*a* toward the base end side of an interference body 10. Therefore, the opening area of the orifice 11 is narrowed from the tip of the interference body 10 toward the base end side. In addition, the corner portions 75 of the opening edge of the orifice 11 formed by the pair of linear outer edge parts 72 and 72 of the interference body 10 and the circular exit side opening 27 of the nozzle hole 10 have an acute and sharp shape without roundness and makes the end of the liquid film of fuel passing though the corner portions 75 of the orifice 11 and its vicinity to sharp so that the fuel is easily atomized by friction with air. In addition, the interference body 20 is provided with the fuel collision surface 34 that is orthogonal to the central axis 10*c* of the nozzle hole 10 and flush with the outer surface 36 of the nozzle hole plate portion 18. Part of fuel passing through the nozzle hole 10 collides with the fuel collision surface 34. In addition, the side surface 35 of the interference body 20 is an inclined plane formed so as to intersect the fuel collision surface 34 at an acute angle. The side surface 35 of the interference body 20 is smoothly connected to the side surface 38 connecting the outer surface 36 of the nozzle hole plate portion 18 to the outer plane 40 of the interference body plate portion 21. The side surface 38 connecting the outer surface 36 of the nozzle hole plate portion 18 to the outer plane 40 of the interference body plate portion 21 is formed in a position in which the flow of spray injected from the orifice 11 formed by the nozzle hole 10 and the interference body 20 is not disturbed.

In addition, in the part of the outer plane 40 (the part close to the outer surface 36 of the nozzle hole plate portion 18 (thin-walled part) of the bottom wall part 15 and the outer surface 37 of the interference body plate portion 21) and in the vicinity of the exit side opening 27 of the nozzle hole 10, spray direction change means 76 as a projection projecting from part close to the outer plane 40 of the bottom wall part 15 is formed integrally. The spray direction change means 76 has an inner wall surface 77 that is substantially U-shaped in plan view. The inner wall surface 77 of the spray direction change means 76 has a curved first inner wall surface part 78 standing so as to surround part of the exit side opening 27 of the nozzle hole 10 and a pair of second inner wall surface parts 80 and 80 extending from both ends of the first inner wall surface part 78 so as to face each other. The first inner wall surface part 78 is a substantially semi-circular tapered surface standing so as to taper toward the outer surface 36 of the nozzle hole plate portion 18 and concentric with the center 10*a* of the nozzle hole 10 and the first inner wall surface part 78 is positioned so as to surround the half in the circumferential direction of the exit side opening 27 of the nozzle hole 10. In addition, the second inner wall surface part 80 has one end smoothly connected to an end of the first inner wall surface part 78 and projects, at the same inclination angle as in the first inner wall surface part 78, from the outer surface 36 of the nozzle hole plate portion 18 and the outer surface 37 of the interference body plate portion 21. The first inner wall surface part 78 and the second inner wall surface part 80 are formed to have dimensions that allow collision of the entire fuel spray injected obliquely forward from the orifice 11 (the exit side opening 27 of the nozzle hole 10), changes the travel direction of the fuel spray injected obliquely forward from the orifice 11 to a direction that depends on the shape of the intake air pipe 2 and the position of an intake port 4, and further atomizes fuel fine particles included in the spray injected from the orifice 11. In addition, the other ends (a U-shaped opening end 87) of the pair of second inner wall surface parts 80, 80 are distant from each other. When fuel is injected from the orifice 11 and the pressure in the vicinity of the orifice 11 is reduced, the second inner wall surface parts 80 also function as air introducing means for introducing air around the spray direction change means 76 along the outer surface 36 of the nozzle hole plate portion 18 and the outer surface 37 of the interference body plate portion 21 to the vicinity of the orifice 11. In addition, the parts of the second inner wall surface parts 80 that do not collide with the fuel spray injected from the orifice 11 are cut obliquely to form a cutout 82. In addition, an outer wall surface 83 of the spray direction change means 76 is an inclined plane to facilitate the removal from the injection molding die 44 during injection molding. In addition, in the spray direction change means 76, the ridge of the cutout 82 is arc-shaped so that the injection molding die 44 for the nozzle plate 5 can be easily machined by a rotary cutting tool such as an end mill. The four spray direction change means 76 described above are formed about the center of the bottom wall part 15: a pair of spray direction change means 76 in the center line 24 parallel to the X-axis and a pair of spray direction change means 76 in the center line 25 parallel to the Y-axis. These spray direction change means 76 are formed four-fold-symmetrically with respect to the center (the central axis 22 of the nozzle plate 5) of the bottom wall part 15 and the spray direction change means 76 are formed so that U-shaped opening ends 81 are positioned facing the radially outward side when the spray direction change means 76 are rotated clockwise by 45 degrees about the center line of the nozzle plate 5 (the center line 24 parallel to the X-axis or the center line 25 parallel to the Y-axis). The angle formed by the inner wall surface 77 of the spray direction change means 76 and the outer surface 36 of the nozzle hole plate portion 18 or the angle formed by the inner wall surface 77 of the spray direction change means 76 and the outer surface 37 of the interference body plate portion 21 are set to an appropriate angle in consideration of the travel direction of spraying.

In addition, as illustrated in FIG. 22A, on the outer plane 40 (the surface opposite to the inner plane 16) of the bottom wall part 15, the eight blades 13 with the same shape are formed at regular intervals about the central axis 22 integrally with the outer plane 40 so as to be positioned radially outward of the interference body plate portion 21. This blade 13 is arc-shaped in plan view and has a constant thickness from the radially inward end to the radially outward end. In addition, the blades 13 is cut obliquely upward so as not to obstruct spray injected from the orifice 11 and the fuel collision prevention part 84 is formed to obtain a space large enough to prevent the spray state of fuel injected from the orifice 11 from being affected. In addition, the blade 13 has the same blade height except the fuel collision prevention part 84 close to the radially inward end. The spacing between the pair of blades 13 and 13 adjacent to each other is reduced from radially outward to radially inward and the blade groove 85 between the blades 13 is narrowed from radially outward to radially inward.

As illustrated in FIG. 22A, in the blade 13, the radially outward end is displaced clockwise (right rotation direction) from the radially inward end. When an air flow from the radially outward end to the radially inward end is generated, this air flow interacts with an air flow generated by another adjacent blade 13 to generate a counterclockwise swirl flow about the central axis 22 of the bottom wall part 15.

In FIG. 22A, on the basis of the center (central axis 22 of the nozzle plate 5) of the bottom wall part 15, the nozzle hole 10 having its center in the center line 24 extending in the +X-axis direction is assumed to be the first nozzle hole 10 and the nozzle holes 10 displaced counterclockwise by a multiple of 90 degrees from the first nozzle hole 10 are assumed to be the second to fourth nozzle holes 10. In addition, in FIG. 22A, it is assumed that the spray direction change means 76 formed about the first nozzle hole 10 is the first spray direction change means 76 and the three spray direction change means 76 displaced counterclockwise by a multiple of 90 degrees about the central axis 22 of the nozzle plate 5 are the second to fourth spray direction change means 76. In addition, in FIG. 22A, when the center (the central axis 22 of the nozzle plate 5) of the bottom wall part 15 is the center of the X-Y coordinate plate of an orthogonal coordinate system, the blade groove 85 having its radially inward end in a position close to the +X axis in the first quadrant is assumed to be the first blade groove 85 and the blade grooves 85 displaced counterclockwise by a multiple of 45 degrees from the first blade groove 85 are assumed to be the second to eighth blade grooves 85.

In FIG. 22A described above, an opening end 86 radially inward of the second blade groove 85 is positioned facing the opening end 87 radially outward of the second spray direction change means 76. In addition, the opening end 86 radially inward of the fourth blade groove 85 is positioned facing the opening end 87 radially outward of the third spray direction change means 76. In addition, the opening end 86 radially inward of the sixth blade groove 85 is positioned facing the opening end 87 radially outward of the fourth spray direction change means 76. In addition, the opening end 86 radially inward of the eighth blade groove 85 is positioned facing the opening end 87 radially outward of the first spray direction change means 76. In addition, in FIG. 22A, the opening end 86 radially inward of the first blade groove 85 is positioned between the opening end 87 radially outward of the first spray direction change means 76 and the opening end 87 radially outward of the second spray direction change means 76. The opening end 86 radially inward of the third blade groove 85 is positioned between the opening end 87 radially outward of the second spray direction change means 76 and the opening end 87 radially outward of the third spray direction change means 76. The opening end 86 radially inward of the fifth blade groove 85 is positioned between the opening end 87 radially outward of the third spray direction change means 76 and the opening end 87 radially outward of the fourth spray direction change means 76. The opening end 86 radially inward of the seventh blade groove 85 is positioned between the opening end 87 radially outward of the fourth spray direction change means 76 and the opening end 87 radially outward of the first spray direction change means 76.

Figure 24A:
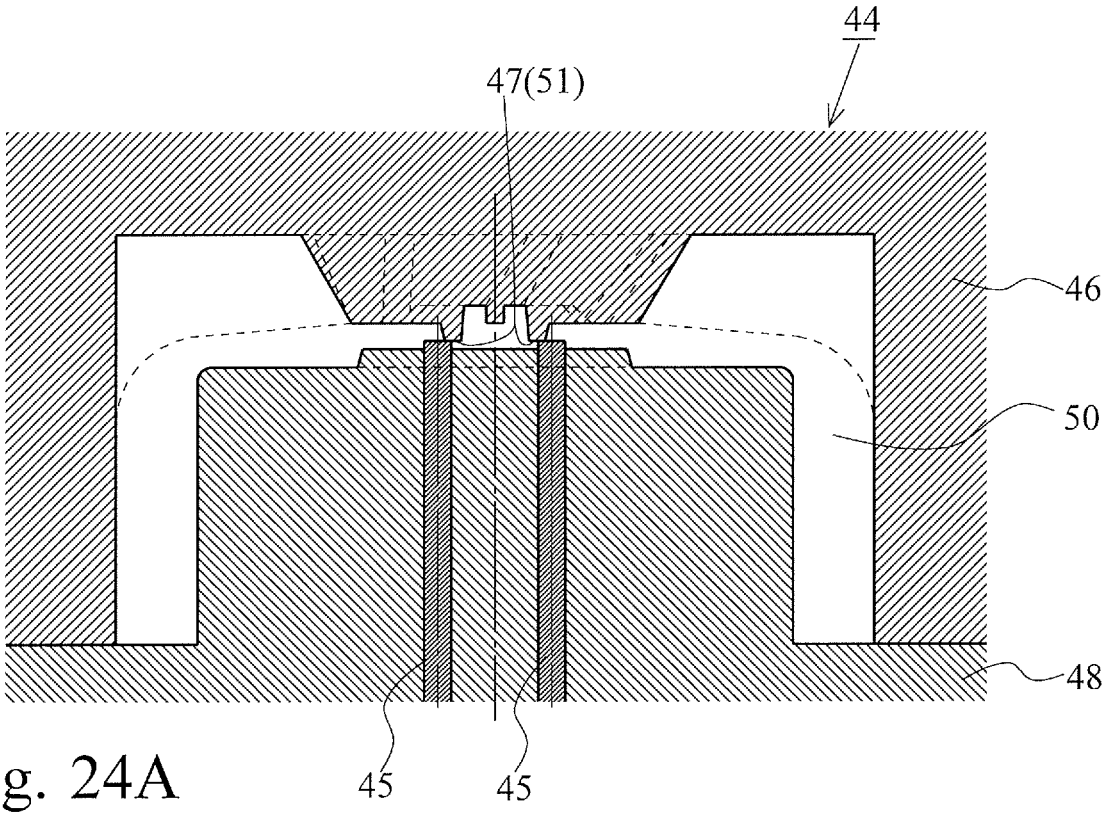
FIGS. 24A-24B are structural diagrams illustrating an injection molding die used for injection molding of the nozzle plate according to the fourth embodiment of the invention.
Figure 24B:
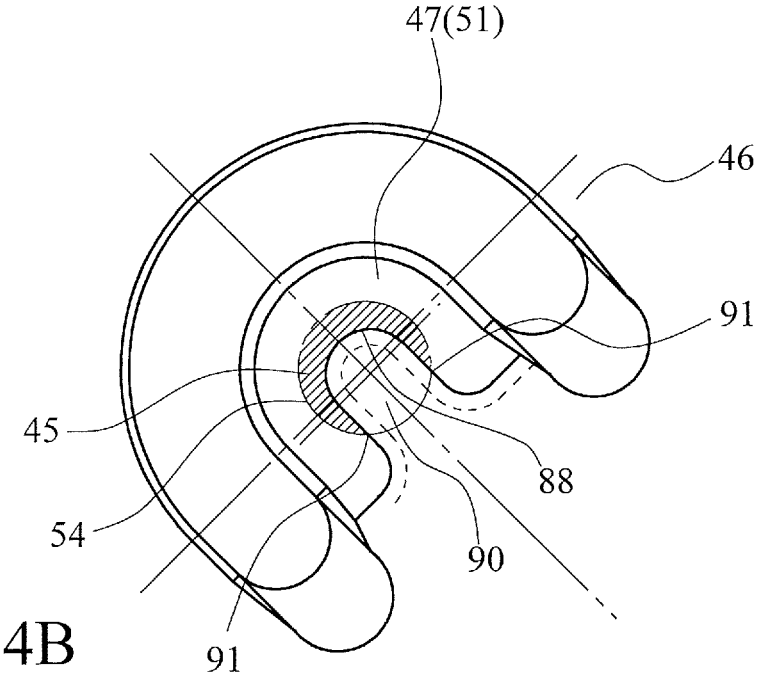
Figure 25A:
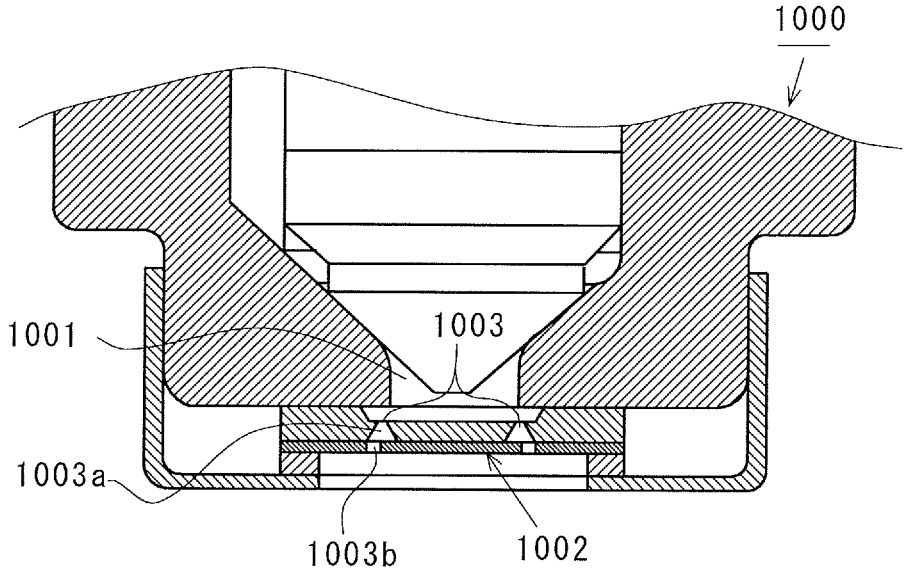
Fig. 25A (Prior Art)
FIGS. 25A-25D illustrate a nozzle plate according to the first conventional example attached to the fuel injection port of a fuel injection device.
Figure 25B:
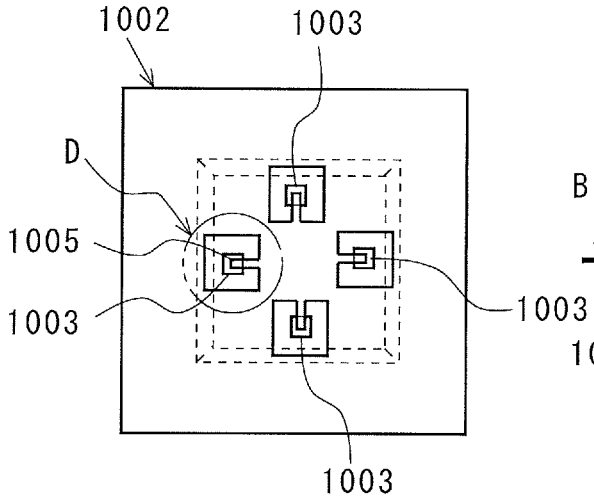
Fig. 25B (Prior Art)
Figure 25C:
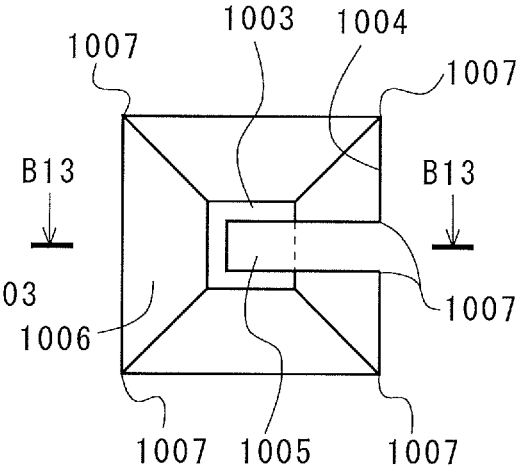
Fig. 25C (Prior Art)
Figure 25D:
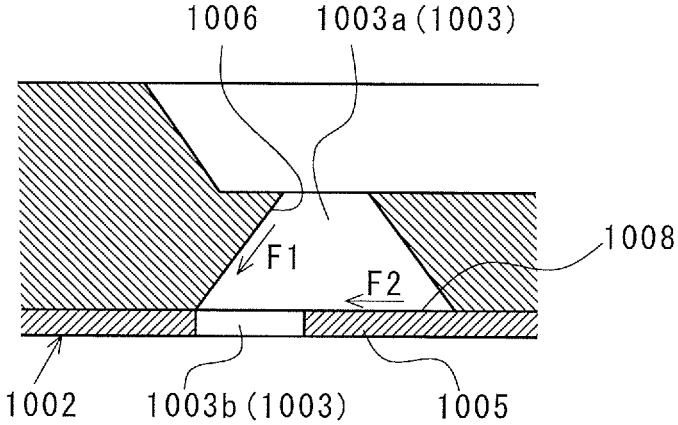
Fig. 25D (Prior Art)
Figure 26:
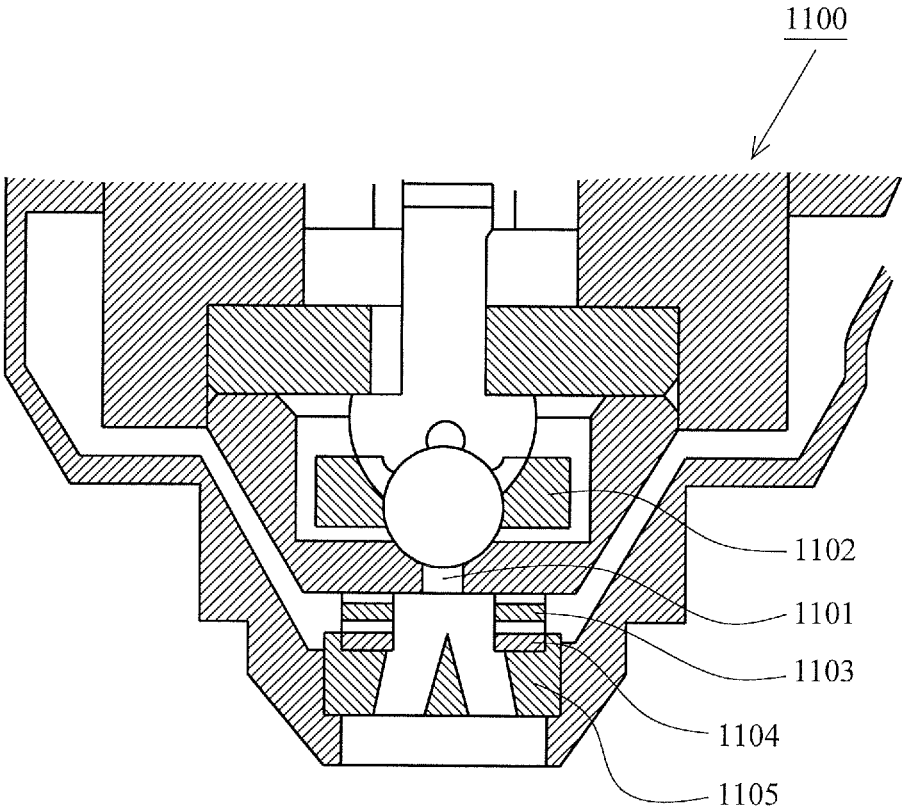
Fig. 26 (Prior Art)
FIG. 26 is a cross sectional view illustrating a fuel injection device according to the second conventional example.

FIG. 24 is a structural diagram illustrating the injection molding die 44 used for injection molding of the nozzle plate 5 according to the embodiment. FIG. 24A is a vertical cross sectional view illustrating the injection molding die 44. In addition, FIG. 24B illustrates a cavity inner plane 47 of a first die 46 against which a nozzle hole formation pin 45 abuts in plan view.

As illustrated in FIG. 24, in the injection molding die 44, the cavity 50 is formed between the first die 46 and the second die 48 and the nozzle hole formation pins 45 for forming the nozzle holes 10 project into the cavity 50. The tip of the nozzle hole formation pin 45 abuts against the cavity inner plane 47 of the first die 46 (see the shaded area in FIG. 24B). The position against which the nozzle hole formation pin 45 of the first die 46 abuts is the convex part 51 for forming the nozzle hole plate portion 18 and the orifice 11. In the convex part 51 of the cavity inner plane 47, an outer edge portion 88 is also the outer edge portion of a recessed portion 90 for forming the interference body 20. The intersecting part between the outer edge portion 88 of the convex part 51 of the cavity inner plane 47 and the front end side outer edge 54 of the nozzle hole formation pin 45 is an acute and sharp corner portion 91 without roundness. The corner portion 91 shaped between the outer edge portion 88 of the convex part 51 of the cavity inner plane 47 and the front end side outer edge 54 of the nozzle hole formation pin 45 forms a corner portion 75 shaped at the intersecting part between the linear outer edge part 72 of the interference body 20 and the circular exit side opening 27 of the nozzle hole 10.

In the injection molding die 44 described above, when molten resin (molten material) is injected from a gate (not illustrated) into the cavity 50 and the molten resin in the cavity 50 is cooled and solidified, the nozzle plate 5 having the plurality of blades 13 integrated with the nozzle plate body 12 is formed (see FIG. 22). In addition, in the nozzle plate 5 injection molded by the injection molding die 44 described above, the fuel collision surface 34 of the interference body 20 and the outer surface 36 of the nozzle hole plate portion 18 are present on a single plane and the acute and sharp corner portions 75 without roundness are formed at the opening edge of the orifice 11. The nozzle plate 5 injection molded as described above has higher efficiency than nozzle plates formed by etching or discharge machining, thereby achieving reduction in the product unit price.

In the nozzle plate 5 according to the embodiment configured as described above, part of fuel injected from the fuel injection port 6 of the fuel injection device 1 collides with the fuel collision surface 34 of the interference body 20 and is atomized, the flow of the fuel is steeply bent by the fuel collision surface 34, the bent flow collides with the fuel attempting to pass straight through the nozzle hole 10 and the orifice 11, and the flow of the fuel attempting to pass straight through the nozzle hole 10 and the orifice 11 is disturbed. In addition, the nozzle plate 5 according to the embodiment has the acute and sharp corner portions 75 without roundness at the opening edge of the orifice 11 and the opening edge of the orifice 11 is narrowed toward the corner portions 75. As a result, in the nozzle plate 5 according to the embodiment, of the fuel injected from the orifice 11, the liquid film of the fuel injected from the corner portions 75 of the orifice 11 and the vicinity of the corner portions 75 becomes thin and acutely sharp, thereby facilitating the atomization of the fuel injected from the corner portions 75 of the orifice 11 and the vicinity of the corner portions 75 by friction with air in the vicinity of the orifice 11. In addition, in the nozzle plate 5 according to the embodiment, the fuel atomized by the corner portions 75 of the orifice 11 and their vicinity collides with the inner wall surface 77 of the spray direction change means 76 and is further atomized (the atomization of fuel fine particles is promoted). In the nozzle plate 1002 according to the first conventional example, since the entrance side nozzle hole part 1003*a* positioned close to the fuel injection port 1001 of the fuel injection device 1000 and the exit side nozzle hole part 1003*b* positioned on the downstream side in the fuel injection direction of the entrance side nozzle hole part 1003*a* are machined by etching, corner parts 1007 of the exit side nozzle hole part 1003*b* are rounded. As a result, in the nozzle plate 1002 according to the first conventional example, the fuel injected from the nozzle hole 1003 does not easily become an acute liquid film, thereby making the atomization of the fuel by friction with air insufficient. As compared with the nozzle plate 1002 according to the first conventional example as described above, the nozzle plate 5 according to the embodiment further improves the degree of atomization of the fuel injected from the orifice 11.

In the nozzle plate 5 according to the embodiment, since the side surface 35 of the interference body 20 is formed to intersect the fuel collision surface 34 of the interference body 20 at an acute angle and an air layer is generated between the fuel passing through the orifice 11 and the side surface 35 of the interference body 20, the fuel passing through the orifice 11 is likely to draw air, thereby promoting the atomization of the fuel passing though the orifice 11.

In the nozzle plate 5 according to the embodiment, since the pressures of the exit side peripheral portions of the orifices 11 are reduced (lower than the atmospheric pressure) when fuel is injected from the orifices 11, the air around the nozzle plate 5 flows (is drawn) from the radially outward end to the radially inward end (opening end 86) of the first to eighth blade grooves 85 and the air flows from the radially inward end (opening end 86) of the first to eighth blade grooves 85 to the opening end 87 of the radially outward of the first to fourth spray direction change means 76 or to the portion between the opening ends 87 and 87 radially outward of the spray direction change means 76 and 76 adjacent to each other. The flows of air flowing from the opening ends 86 radially inward of the first to eighth blade grooves 85 to the radially inward side of the bottom wall part 15 move about the center (the central axis 22 of the nozzle plate 5) of the bottom wall part 15 and causes a counterclockwise swirl flow about the central axis 22 of the nozzle plate 5. In addition, when fuel is injected from the orifices 11, the spray having drawn the air introduced from the opening end 87 radially outward of the spray direction change means 76 to the vicinity of the nozzle hole 10 and the air around the spray direction change means 76 collides with the substantially U-shaped inner wall surface 77 of the spray direction change means 76 and atomized droplets in the spray are further atomized. The atomized droplets (fine particles of fuel) in the spray have kinetic momentum (counterclockwise speed component), draw peripheral air and air swirling around the periphery, and provide the drawn air with kinetic momentum. The air having kinetic momentum flows helically and transports the droplets (fine particles of fuel). The droplets (fine particles of fuel) in the spray are prevented from scattering peripherally because they are transported by the helical air flow. Accordingly, the nozzle plate 5 according to the embodiment can reduce the amount of fuel attached to the wall surface of the intake air pipe 2, thereby improving the utilization efficiency of fuel (see FIG. 1).

In addition, in the nozzle plate 5 according to the embodiment, since the eight blades 13 are formed at regular intervals about the central axis 22 integrally with the bottom wall part 15 so as to be positioned radially outward of the interference body plate portion 21, the blades 13 can prevent a tool or the like from colliding with the nozzle hole 10 and its periphery when the nozzle plate 5 is assembled to the valve body 7 and the blades 13 can prevent the nozzle hole 10 of the bottom wall part 15 and its peripheral portions from being damaged. In addition, in the nozzle plate 5 according to the embodiment, when the fuel injection device 1 having the nozzle plate 5 assembled to the valve body 7 is assembled to the intake air pipe 2 of the engine, the blades 13 can prevent engine components and the like from colliding with the nozzle hole 10 and its periphery and the blades 13 can prevent the nozzle hole 10 of the bottom wall part 15 and its peripheral portions from being damaged.

(Modification of Fourth Embodiment)

In the nozzle plate 5 according to the fourth embodiment of the invention, the four nozzle holes 10 and the four spray direction change means 76 are formed at regular intervals about the central axis 22 of the bottom wall part 15. However, the invention is not limited to the embodiment and, for example, the two nozzle holes 10 and the two spray direction change means 76 may be formed at regular intervals about the central axis 22 of the bottom wall part 15. In addition, one nozzle hole 10 and one spray direction change means 76 may be formed in the bottom wall part 15.

In addition, in the above nozzle plate 5 according to the fourth embodiment, the four nozzle holes 10 are formed and twice as many (eight) blades 13 as the nozzle holes 10 are provided. However, the invention is not limited to the embodiment and a plurality of (two or more) nozzle holes 10 may be formed and twice as many blades 13 as nozzle holes 10 may be provided. In addition, in the above nozzle plate 5 according to the fourth embodiment, twice as many blade grooves 85 as the nozzle holes 10 are provided. However, the invention is not limited to the embodiment and as many blade grooves 85 as the nozzle holes 10 may be provided. In addition, in the above nozzle plate 5 according to the fourth embodiment, twice as many blade grooves 85 as the nozzle holes 10 are formed. However, the invention is not limited to the embodiment and a number of the blade grooves 85 equal to a multiple of the number of the nozzle holes 10 may be provided.

In addition, in the above nozzle plate 5 according to the fourth embodiment, the shapes (right hand helix shapes) of the orifices 11, the spray direction change means 76, and the blades 13 are determined so as to generate a counterclockwise swirl flow about the central axis 22 of the bottom wall part 15. However, the invention is not limited to the nozzle plate 5 according to the fourth embodiment and the shapes (left hand helix shapes) of the orifices 11, the spray direction change means 76, and the blades 13 may be determined so as to generate a clockwise swirl flow about the central axis 22 of the bottom wall part 15.

In addition, in the above nozzle plate 5 according to the fourth embodiment, the blade 13 is arc-shaped in plan view (see FIG. 22A), but the invention is not limited to the embodiment and the blade 13 may be linear in plan view.

In addition, in the above nozzle plate 5 according to the fourth embodiment, a pin point gate may be provided in the injection molding die 44 so that a gate mark is positioned in a portion (for example, the central point of the bottom wall part 15) surrounded by the plurality of nozzle holes 10 and the spray direction change means 76.

Other Embodiments

In the nozzle plates 5 according to the above embodiments, when fuel can be atomized and injected by improving the shape of the nozzle hole 10, the interference body 20 and the orifice 11 formed by the interference body 20 may be omitted and fuel may be injected from the exit side opening 27 of the nozzle hole 10.

In addition, it is possible to apply the shapes of the interference bodies and orifices disclosed by the applicant of this application in other patent applications (Japanese Patent Application No. 2013-256822 and Japanese Patent Application No. 2013-256869) to the nozzle plates 5 according to the above embodiments. In the nozzle plate 5 according to the invention, the nozzle holes 10 do not need to be partially blocked by the plurality of interference bodies 20 and the nozzle holes 10 may be partially blocked by the single interference body 20 as illustrated in, for example, FIG. 23A.

In addition, the nozzle plate 5 according to the invention does not need to be injection molded using synthetic resin material (for example, PPS, PEEK, POM, PA, PES, PEI, or LCP) and the nozzle plate 5 may be injection molded using metal powder.

In addition, in the nozzle plates 5 according to the above embodiments, the plurality of nozzle holes 10 and the plurality of blades 13 are disposed at regular intervals about the central axis 22 of the nozzle plate 5. However, the invention is not limited to the embodiments and the plurality of nozzle holes 10 and the plurality of blades 13 may be disposed at irregular intervals about the central axis 22 of the nozzle plate 5.

In addition, in the nozzle plates 5 according to the above embodiments, the plurality of nozzle holes 10 are provided in a single circle about the central point (the central axis 22 of the nozzle plate 5) of the bottom wall part 15. However, the invention is not limited to the embodiments and at least one nozzle hole 10 may be displaced radially inward or radially outward of the other nozzle holes 10.

In addition, the nozzle plates 5 according to the above embodiments may have a shape in which the cylindrical wall part 14 may be omitted (removed) and the bottom wall part 15 may be fixed to the front end surface 17 of the valve body 7.

REFERENCE SIGNS LIST

1: fuel injection device
2: intake air pipe
5: nozzle plate (fuel injection device nozzle plate)
6: fuel injection port
10: nozzle hole
13: blade
15: bottom wall part
16: inner plane
40: outer plane

The invention claimed is:

1. A nozzle plate to be attached to a front end of a valve body, the valve body having a fuel injection port, said nozzle plate comprising:

a bottom wall part facing the fuel injection port and having a nozzle hole through which fuel injected from the fuel injection port is to pass, the bottom wall part being formed separate from the valve body and being configured to inject fuel from the fuel injection port through the nozzle hole into an intake air pipe, a first surface of the bottom wall part facing the fuel injection port to abut against a front end surface of the valve body, the first surface being defined as an inner plane and a second surface of the bottom wall part opposite to the first surface being defined as an outer plane, the inner plane and the outer plane defining front and rear surfaces of the bottom wall part, respectively, the second surface of the bottom wall part being perpendicular to a central axis of the nozzle plate;

a cylindrical wall part extending from the inner plane of the bottom wall part in a direction along the central axis of the nozzle plate so as to fit onto an outer periphery of the front end of the valve body;

a plurality of blades formed in an area of the outer plane of the bottom wall part so as to surround the nozzle hole, the bottom wall part, the cylindrical wall part, and the blades being integrally formed to have a monolithic one-piece construction, the blades protruding from the second surface of the bottom wall part along the central axis of the nozzle plate;

wherein the bottom wall part and the blades are configured such that, when the fuel is injected from the nozzle hole and a pressure in the vicinity of the nozzle hole is reduced, the plurality of blades guide a flow of air from a radially outward side of the bottom wall part to a radially inward side of the bottom wall part to generate a swirling flow of the air about a center of the bottom wall part; and wherein the bottom wall part and the blades are configured such that the swirling flow of the air about the center of the bottom wall part changes to a helical flow by receiving kinetic momentum from fine particles of the fuel injected from the nozzle hole and the helical flow of the air transports the fine particles of the fuel.

2. The nozzle plate according to claim 1, further comprising a conical projection formed at a central point of the bottom wall part on the second surface forming the outer plane of the bottom wall part, and the nozzle hole is formed radially outward of the conical projection and radially inward of the plurality of blades.

3. The nozzle plate according to claim 2, wherein the nozzle hole is a first nozzle hole of a plurality of nozzle holes formed around the conical projection.

4. The nozzle plate according to claim 2, wherein the nozzle hole is a first nozzle hole of a plurality of nozzle holes formed at regular intervals around the conical projection.

5. The nozzle plate according to claim 1, wherein the nozzle hole is a first nozzle hole of a plurality of nozzle holes formed about the center of the bottom wall part and radially inward of the plurality of blades.

6. The nozzle plate according to claim 1, further comprising an interference body configured to partially block an exit side opening of the nozzle hole, the exit side opening being an opening on a fuel outflow side, to form an orifice for reducing a fuel flow at the exit side opening, the orifice being formed to inject the fuel in a direction identical to a swirling direction of the swirling flow of the air generated by the plurality of blades.

7. The nozzle plate according to claim 6, wherein the orifice is formed so that an injection direction of the fuel is oriented toward a center of the nozzle hole positioned on a downstream side along the swirling direction of the swirling flow of the air.

8. The nozzle plate according to claim 6, wherein the bottom wall part, the interference body, and the blades are formed integrally by cooling and solidifying molten material filling a cavity, wherein the interference body is configured to atomize part of the fuel passing through the nozzle hole by colliding with the part of the fuel passing through the nozzle hole to disturb a flow of the fuel so that the fuel having passed through the orifice is easily atomized in the air by steeply bending a flow of the part of the fuel passing through the nozzle hole and casing the bent flow to collide with the fuel attempting to pass straight through the nozzle hole and the orifice, wherein the orifice has an acute and sharp corner portion without roundness formed by an outer edge part of the interference body in part of an opening edge, and wherein the corner portion of the orifice makes an end of a liquid film of the fuel passing through the orifice acute and sharp so that the fuel is easily atomized by friction with air.

9. The nozzle plate according to claim 8, wherein the interference body is one of a plurality of interference bodies, the exit side opening of the nozzle hole being partially blocked by the plurality of interference bodies, wherein each of the interference bodies has an arc-shaped outer edge part forming part of the opening edge of the orifice, and wherein the corner portion is formed in an abutting part between the arc-shaped outer edge parts of the interference bodies adjacent to each other.

10. The nozzle plate according to claim 8, wherein the corner portion is formed by a linear outer edge part of the interference body and the exit side opening of arc shape of the nozzle hole.

11. The nozzle plate according to claim 8, wherein the corner portion is formed by an arc-shaped outer edge part of the interference body and the exit side opening of the nozzle hole, the exit side opening having an arc shape.

12. The nozzle plate according to claim 6, further comprising a spray direction change member configured to change a travel direction of fuel spray injected from the orifice by colliding with the fuel spray, the spray direction change member being integrally formed on the outer plane of the bottom wall part and on an exit side of the nozzle hole.

13. The nozzle plate according to claim 1, wherein the nozzle hole is a first nozzle hole of a plurality of nozzle holes formed about a central point of the bottom wall part and radially inward of the plurality of blades, an exit side opening being an opening on a fuel outflow side of each of the nozzle holes, said nozzle plate further comprising a plurality of interference bodies, each of the interference bodies being configured to partially block the exit side opening of a respective one of the nozzle holes to form an orifice for reducing a fuel flow at the exit side opening, and wherein the orifice is formed to inject the fuel in a direction identical to a swirling direction of the swirling flow of the air generated by the plurality of blades.

14. The nozzle plate according to claim 13, wherein a central nozzle hole is formed at the central point of the bottom wall part.

15. The nozzle plate according to claim 1, wherein the nozzle hole is a first nozzle hole of a plurality of nozzle holes formed at regular intervals in a circumference about a central point of the bottom wall part and radially inward of the plurality of blades, and an exit side opening being an opening on a fuel outflow side of each of the nozzle holes;

said nozzle plate further comprising a plurality of interference bodies, each of the interference bodies being configured to partially the exit side opening of a respective one of the nozzle holes to form an orifice for reducing a fuel flow at the exit side opening; and wherein the orifice is formed so as to inject the fuel in a direction identical to a swirling direction of the swirling flow of the air generated by the plurality of blades.

16. The nozzle plate according to claim 1, wherein said nozzle plate is configured to be attached to the front end of the valve body such that the central axis of the bottom wall part is also a central axis of the valve body, the nozzle hole extending through the second surface of the bottom wall part.

* * * * *